US012427359B2

(12) United States Patent
Miller

(10) Patent No.: US 12,427,359 B2
(45) Date of Patent: Sep. 30, 2025

(54) WEIGHTED COMPRESSION SLEEVES

(71) Applicant: HVY Sleeves LLC, Jupiter, FL (US)

(72) Inventor: Joshua Miller, Jupiter, FL (US)

(73) Assignee: HVY SLEEVES LLC, Palm Beach Gardens, FL (US)

( * ) Notice: Subject to any disclaimer, the term of this patent is extended or adjusted under 35 U.S.C. 154(b) by 0 days.

(21) Appl. No.: 18/696,801

(22) PCT Filed: Aug. 16, 2023

(86) PCT No.: PCT/US2023/072267

§ 371 (c)(1),
(2) Date: Mar. 28, 2024

(87) PCT Pub. No.: WO2024/044487

PCT Pub. Date: Feb. 29, 2024

(65) Prior Publication Data

US 2024/0390724 A1 Nov. 28, 2024

Related U.S. Application Data

(60) Provisional application No. 63/491,998, filed on Mar. 24, 2023, provisional application No. 63/377,286, (Continued)

(51) Int. Cl.

| | |
|---|---|
| ***A63B 21/065*** | (2006.01) |
| ***A41D 27/20*** | (2006.01) |
| ***A44B 13/00*** | (2006.01) |

(52) U.S. Cl.
CPC ..... *A63B 21/065* (2013.01); *A41D 27/20* (2013.01); *A44B 13/00* (2013.01)

(58) Field of Classification Search
CPC ..... A63B 21/065; A41D 27/20; A44B 13/00
See application file for complete search history.

(56) References Cited

U.S. PATENT DOCUMENTS 3,924,851 A * 12/1975 Winston ..... A63B 21/4021 482/105
4,330,120 A * 5/1982 Netti ..... A63B 21/065 2/160

(Continued)

OTHER PUBLICATIONS

International Search Report and Written Opinion, PCT/US23/72267, Jan. 23, 2024, 20 Pages.

(Continued)

*Primary Examiner* — Andrew S Lo
(74) *Attorney, Agent, or Firm* — Goodhue, Coleman & Owens, P.C.

(57) ABSTRACT

A compression sleeve includes a compression sleeve body having a superior opening and an opposite inferior opening for fitting to a body part. The compression sleeve body is comprised of a form fitting elastomeric fabric. The compression sleeve has an inside surface for fitting to the body part and an opposite outside surface. The compression sleeve includes an elongated first pocket extending along a longitudinal axis extending between the superior opening and the opposite inferior opening and an elongated first weight for fitting within the elongated first pocket. The compression sleeve body may include a first hook and fastener area at a top portion of the compression sleeve body and a second hook and fastener area at a bottom portion of the compression sleeve.

28 Claims, 21 Drawing Sheets

Related U.S. Application Data filed on Sep. 27, 2022, provisional application No. 63/400,205, filed on Aug. 23, 2022.

(56) References Cited

U.S. PATENT DOCUMENTS 4,905,991 A * 3/1990 Alston ..... A63B 21/065 441/59
4,966,365 A * 10/1990 Winston ..... A63B 21/065 482/105
5,127,891 A * 7/1992 Winston ..... A63B 21/065 482/50
5,514,056 A * 5/1996 Ronca ..... A63B 21/065 482/74
6,048,326 A * 4/2000 Davis ..... A61F 7/03 607/108
6,669,608 B1 * 12/2003 Winston ..... A63B 21/4007 2/102
7,942,838 B2 5/2011 Farrow
8,221,340 B2 7/2012 Farrow
8,251,933 B2 8/2012 Farrow
8,747,341 B2 6/2014 Farrow
8,808,210 B2 8/2014 Farrow
9,283,135 B2 3/2016 Farrow
9,861,851 B1 * 1/2018 Owens ..... A63B 21/4017
10,857,412 B2 * 12/2020 Auguste ..... A63B 69/00
2002/0010058 A1 1/2002 Myrick
2003/0130070 A1 * 7/2003 Nolan ..... A63B 21/0605 473/437
2005/0203455 A1 * 9/2005 Cropper ..... A61F 5/0123 602/26
2006/0094999 A1 * 5/2006 Cropper ..... A61F 5/0109 602/62
2008/0280737 A1 11/2008 Cook
2010/0285936 A1 * 11/2010 Tacker ..... A63B 21/0602 482/105
2010/0311551 A1 12/2010 Winston
2011/0009713 A1 * 1/2011 Feinberg ..... A63B 21/065 482/8
2011/0043755 A1 * 2/2011 Gibson-Horn ..... A61F 5/028 351/203
2011/0247127 A1 * 10/2011 Pou ..... A41D 13/0012 2/338
2012/0078151 A1 * 3/2012 Cropper ..... A61F 5/30 602/26
2012/0330203 A1 * 12/2012 Jones ..... A61F 5/0123 602/16
2013/0017933 A1 * 1/2013 Foster ..... A41D 31/102 2/69
2013/0085428 A1 * 4/2013 Deshpande ..... A61H 9/0092 601/148
2015/0250236 A1 * 9/2015 Garcia ..... A41D 13/0543 2/22
2016/0030251 A1 * 2/2016 Schuren ..... A61F 13/085 602/75
2016/0310779 A1 * 10/2016 Porter ..... A63B 21/00065
2017/0065843 A1 * 3/2017 Foster ..... A41D 31/102
2017/0100623 A1 * 4/2017 Tacker ..... A63B 21/065
2017/0273830 A1 * 9/2017 Hitschmann ..... A61F 13/108
2018/0043201 A1 * 2/2018 Pozo ..... A63B 21/4017
2018/0228633 A1 * 8/2018 Carey ..... A61F 5/30
2019/0247699 A1 * 8/2019 Gineris ..... A63B 21/4015
2020/0179743 A1 * 6/2020 Brown ..... A41D 27/20
2022/0040518 A1 2/2022 Thomas
2023/0329373 A1 * 10/2023 Buchanan ..... A41D 31/18

OTHER PUBLICATIONS

International Preliminary Report on Patentability, PCT/US23/72267, Jul. 2, 2024, 15 Pages.

* cited by examiner

WEIGHTED COMPRESSION SLEEVES

RELATED APPLICATION

This application claims priority to U.S. Provisional Patent Application 63/400,205, filed Aug. 23, 2022; U.S. Provisional Patent Application 63/377,286, filed Sep. 27, 2022, and U.S. Provisional Patent Application 63/491,998, filed Mar. 24, 2023, all of which are hereby incorporated by reference in their entireties.

FIELD OF THE INVENTION

The present invention relates to compression garments. More particularly, but not exclusively, the present invention relates to weighted compression garments such as arm sleeves, leg sleeves, and socks.

BACKGROUND OF THE ART

Although various types of compression garments exist including compression sleeves and compression socks, the full potential for compression garments has not yet been realized.

In addition, although seemingly unrelated without having the benefit of this disclosure, there are problems in the art with respect to performing weighted exercises especially for relatively low weights such as may associated with ankle weights or light dumbbells. Ankle weights may place weights indiscriminately around an individual's ankle without regard to placement of the bone and ankle weights may be unwieldy. Thus, an individual may be inclined not to use ankle weights or if used, ankle weights may stress the ankle in unwanted ways. Light dumbbells may be used in performing exercise. For example, some individuals may carry light dumbbells while walking. But using dumbbells in this manner requires use of the hands and so may be undesirable as an individual may need to keep their hands free for other purposes such as carrying a drink or phone.

SUMMARY OF THE INVENTION

Therefore, it is a primary object, feature, or advantage to improve over the state of the art.

It is a further object, feature, or advantage to provide for weighted compression garments such as weighted compression sleeves.

It is another object, feature, or advantage to provide for weighted compression sleeves which allow for removable weights.

Yet another object, feature, or advantage is to provide for weighted compression sleeves which provide therapeutic benefits.

A further object, feature, or advantage is to provide for sports performance benefits.

A still further object, feature or advantage is to provide for weighted compression sleeves which allow for precise weight positioning so that weight may be distributed along a length of a bone or otherwise.

A still further object, feature, or advantage is to provide for weighted compression sleeves which may be used by people with an active lifestyle in order to improve strength.

Another object, feature, or advantage is to provide for weighted compression sleeves which provide for therapeutic benefit and may be used to improve strength such as a part of a rehabilitation program.

Yet another object, feature, or advantage is to provide allow an individual to receive benefits of weighted training or activity in a handsfree manner.

A further object, feature, or advantage is to provide for weighted compression sleeves which are capable of accommodating different weights.

A still further object, feature, or advantage is to provide for a product which may be branded such as with different team colors, names, or logos.

Another object, feature, or advantage is to allow for smaller weights, of different geometries which may be placed in different locations to allow for elimination of the need for a strap to secure the weighted compression sleeve.

Yet another object, feature, or advantage is to allow for the use of an inner pocket as opposed to an outer pocket allows for insertion and placement of weight next to the body.

Another object, feature, or advantage is to allow for the use of an outer pocket which allows a weight to be inserted from the outside in order to enhance convenience for the individual while still allowing for insertion and placement of weight next to the body of the individual.

A further object, feature, or advantage is to allow for a sewn-pocket such that an individual need not insert or remove weights.

Another object, feature, or advantage is to allow for both an inner pocket and an outer pocket for holding weights or other therapeutic items such as heat packs.

A further object, feature, or advantage is to provide multiple pockets and/or pockets of different placement.

Yet another object, feature, or advantage is to provide a pocket structure with beaded weights allow for excellent mobility and weight distribution.

One or more of these and/or other objects, features, or advantages will become apparent from the specification and claims that follow. No single embodiment need exhibit each and every object, feature, or advantage. Different embodiments may have different objects, features, or advantages. The present invention is not to be limited to or by these objects, features, or advantages.

According to one aspect, a compression sleeve is provided. The compression sleeve includes a compression sleeve body having a superior opening and an opposite inferior opening for fitting to a body part. The compression sleeve body is comprised of a form fitting elastomeric fabric. The compression sleeve has an inside surface for fitting to the body part and an opposite outside surface. The compression sleeve includes an elongated first pocket extending along a longitudinal axis extending between the superior opening and the opposite inferior opening and an elongated first weight for fitting within the elongated first pocket. The compression sleeve body may include a first hook and fastener area at a top portion of the compression sleeve body and a second hook and fastener area at a bottom portion of the compression sleeve. A top portion of the elongated first pocket is at the first hook and fastener area and a bottom portion of the elongated first pocket is at the second hook and fastener area. The elongated first pocket may have an opening to provide access to the elongated first pocket for inserting and removing the elongated first weight from the pocket.

According to one aspect, a compression sleeve is provided. The compression sleeve includes a compression sleeve body having a superior opening and an opposite inferior opening for fitting to a body part. The compression sleeve body includes a form fitting elastomeric fabric. The compression sleeve body has an inside surface for fitting to the body part and an opposite outside surface. There is an elongated first pocket disposed at the inside surface, the elongated first pocket extending along a longitudinal axis extending between the superior opening and the inferior opening. There is an elongated first weight for fitting within the elongated first pocket. The compression sleeve may further include a sheath encapsulating the elongated first weight. The sheath may be formed from a plastic coating or other material which may be moisture resistant and/or rust-proof. The elongated first weight may be formed from a metal alloy such as steel. The elongated first weight may weigh less than one pound. The elongated first pocket has an opening to provide access to the elongated pocketing for inserting and removing the elongated first weight from the pocket. The opening may be positioned along a superior edge of the elongated first pocket. The form fitting elastomeric fabric may be formed to include elastane. The compression sleeve may be an arm compression sleeve for fitting to an arm and the elongated first weight within the elongated first pocket may be positioned for fitting along the forearm. The compression sleeve may be a leg compression sleeve and the elongated first weight within the elongated first pocket may be positioned for fitting along a shin of the leg. The compression sleeve may further include an elongated second pocket disposed at the inside surface and spaced apart from the elongated first pocket. The compression sleeve may further include an elongated second weight for fitting within the elongated second pocket. The elongated first and/or second weight may have lengths of about 6 inches, about 7 inches, or other appropriate dimensions.

According to another aspect, a method of training to promote improved physical performance is provided. The method may include providing a compression sleeve, the compression sleeve having a compression sleeve body having a superior opening and an opposite inferior opening for fitting to a body part with the compression sleeve body comprised of a form fitting elastomeric fabric. The compression sleeve may have an inside surface for fitting to the body part and an opposite outside surface. The compression sleeve may further include an elongated first pocket disposed at the inside surface, the elongated first pocket extending along a longitudinal axis extending between the superior opening and the inferior opening. The compression sleeve may further have an elongated first weight for fitting within the elongated first pocket. The method may further include fitting the compression sleeve to the body with the elongated first weight within the elongated first pocket and positioned along a bone of the body part such that weight of the elongated first weight is distributed along the bone of the body part. The method may further include performing physical activity using the body part. The physical activity may be a sports activity. The compression sleeve may be an arm compression sleeve and the elongated first weight within the elongated first pocket is positioned for fitting along the forearm. The compression sleeve may be a leg compression sleeve, and the elongated first weight within the elongated first pocket is positioned for fitting along a shin of the leg.

According to another aspect, a compression garment is provided. The compression garment includes a compression garment body for fitting to a body part wherein the compression garment body has an opening and is made from a form fitting elastomeric fabric. The compression garment body may have an inside surface for fitting to the body part and an opposite outside surface. The elongated first pocket may be disposed at the inside surface, the elongated first pocket configured to extend along a longitudinal axis of the body part. The compression garment may further include an elongated first weight for fitting within the elongated first pocket. The compression garment may be a sock or a sleeve.

According to another aspect, a method for customization of a compression sleeve includes displaying a user interface at a computing device for a user to use to customization a compression sleeve, receiving through the user interface a selection from the user of a type of compression sleeve, receiving through the user interface a selection of at least one of a color or pattern of the compression sleeve, receiving through the user interface a selection of a size of weight for use in the compression sleeve, and submitting an order through the user interface at the computing device for a compression sleeve customized to the type of compression sleeve, the at least one of the color or pattern of the compression sleeve, and the size of weight for use in the compression sleeve. The method may further include receiving through the user interface an upload from the user containing an image to incorporate into the compression sleeve. The method may further include receiving through the user interface at the computing device a selection of a quantity of heat packs.

According to another aspect, a compression sleeve includes a compression sleeve body having a superior opening and an opposite inferior opening for fitting to a body part, the compression sleeve body comprised of a form fitting elastomeric fabric, the compression sleeve having an inside surface for fitting to the body part and an opposite outside surface, an elongated first pocket disposed at the inside surface, the elongated first pocket extending along a longitudinal axis extending between the superior opening and the inferior opening, and a heat pack for fitting within the elongated first pocket. The heat pack may be a chemical heat pack.

According to another aspect, a compression garment includes a compression garment body for fitting to a body part, the compression garment body having an opening, the compression garment body comprised of a form fitting elastomeric fabric, the compression garment body having an inside surface for fitting to the body part and an opposite outside surface, an elongated first pocket disposed at the inside surface, the elongated first pocket configured to extend along a longitudinal axis of the body part, and a heat pack for fitting within the elongated first pocket. The heat pack may be a chemical heat pack.

According to another aspect, a compression sleeve may include a compression sleeve body having a superior opening and an opposite inferior opening for fitting to a body part. The compression sleeve body may be made of a form fitting elastomeric fabric. The compression sleeve may have an inside surface for fitting to the body part and an opposite outside surface. The compression sleeve may have an elongated first pocket within the compression sleeve body, a plurality of compartments within the elongated first pocket, a plurality of weights within each of the plurality of compartments, and separators between adjacent compartments of the plurality of compartments to prevent weights from moving between the adjacent compartments. The weights may be beaded weights and the elongated first pocket may be sealed such as being sewn shut during the manufacturing process.

According to another aspect, a method for treatment of an individual includes providing a compression sleeve comprising a compression sleeve body having a superior opening and an opposite inferior opening for fitting to a body part, the compression sleeve body comprised of a form fitting elastomeric fabric, the compression sleeve having an inside surface for fitting to the body part and an opposite outside surface, a plurality of pockets, wherein a first subset of the pockets are accessible to a user for insertion of at least one of a weight and a heat pack, wherein a second subset of the pockets are sealed and inaccessible to the user and wherein the second subset of the pockets contain weights, determining a number of weights and placement of the weights within the compression sleeve for use while performing an activity, and storing in a computer readable medium the number of weights and placement of the weights within the compression sleeve for use while performing an activity.

DETAILED DESCRIPTION

Figure 1:
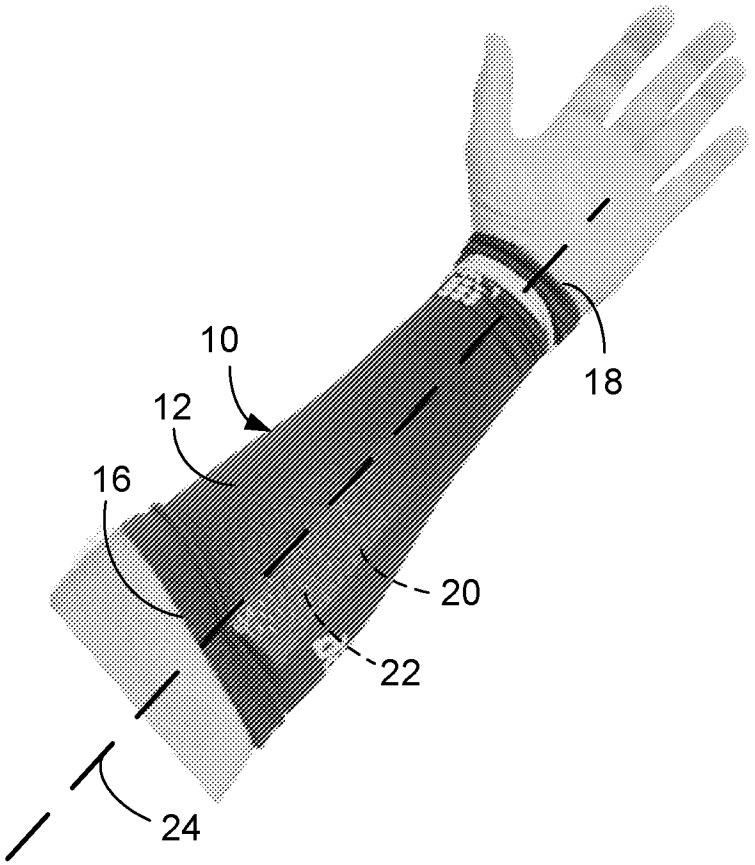
FIG. 1 illustrates a weighted compression sleeve on an arm of an individual.

FIG. 1 illustrates one example of a compression sleeve 10 in use on an arm of an individual. The compression sleeve 10 has a compression sleeve body 12 having a superior opening 16 and an opposite inferior opening 18 for fitting to a body part, in this instance an arm of an individual. The terms "superior" and "inferior" are used herein in a manner generally consistent with medical terminology in that the superior opening is located above the inferior opening when the body is an upright and neutral state.

The compression sleeve body 12 may be made from a form fitting elastomeric fabric such as nylon or elastane. The compression sleeve body 12 may be made from any number of form fitting elastomeric fabrics. Elastane is one example of a form fitting elastomeric fabric which may be branded as SPANDEX, LYCRA, or otherwise. Nylon is another example of a form fitting elastomeric fabric. It is to be understood, however than any number of other types of fabrics and fabric blends may be used which provide sufficient elastomeric properties and sufficient comfort for individuals. The compression sleeve body 12 may provide for uniform compression or in some embodiments, the compression sleeve body 12 may provide for graduated compression or otherwise have some areas constructed to apply greater compression than other areas.

The compression sleeve body 12 has an inside surface for fitting to the body part and an opposite outside surface 30. There is an elongated pocket 20 disposed at the inside surface. The elongated pocket 20 and may be positioned along a longitudinal axis extending between the superior opening and the inferior opening. Thus, the elongated pocket 20 would extend along the forearm bone of the individual. The elongated pocket 20 is sized and shaped to hold an elongated weight 22 so that the elongated weight 22 can fit snugly within the pocket 20 when the compression sleeve 10 is worn by an individual.

A longitudinal axis 24 is shown which extends between the superior opening 16 and the inferior opening 18. The longitudinal axis 24 may be aligned with a bone of an individual such that the elongated weight 22 is aligned with the bone of the individual and the weight of the elongated weight 22 is distributed along the bone. As shown in FIG. 1, the compression sleeve 10 is an arm compression sleeve for fitting an arm of an individual such that the elongated weight 22 fits along the forearm.

It is to be understood that where the compression sleeve 10 is an arm compression sleeve, the compression sleeve may extend further such that the compression sleeve 10 may fit over the elbow of an individual.

Figure 2:
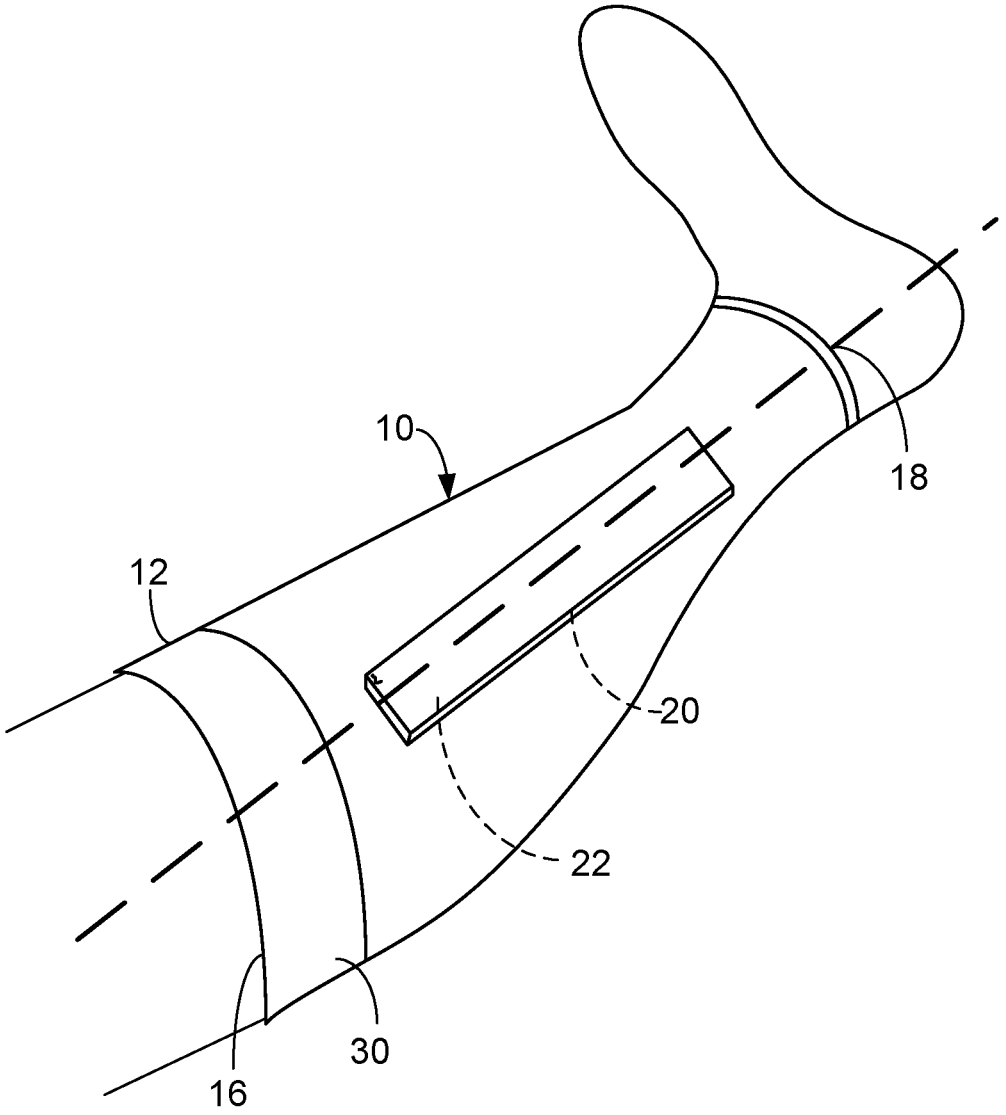
FIG. 2 illustrates the weighted compression sleeve on a leg of an individual.

FIG. 2 illustrates another example of a compression sleeve 10 in use on a leg of an individual. The compression sleeve of FIG. 2 may be of the same size as the compression sleeve for an arm or may be larger depending on the requirements for a particular individual. As shown in FIG. 2, the longitudinal axis 24 may be aligned with a bone of an individual such that the elongated weight 22 is aligned with a shin bone of the individual and the weight of the elongated weight 22 is distributed along the shin bone.

Figure 3:
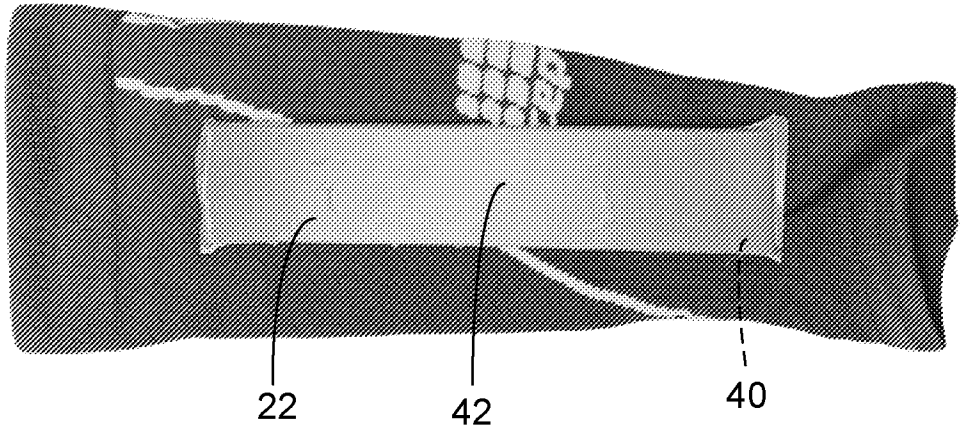
FIG. 3 illustrates a compression sleeve with a single removable weight.
Figure 4:
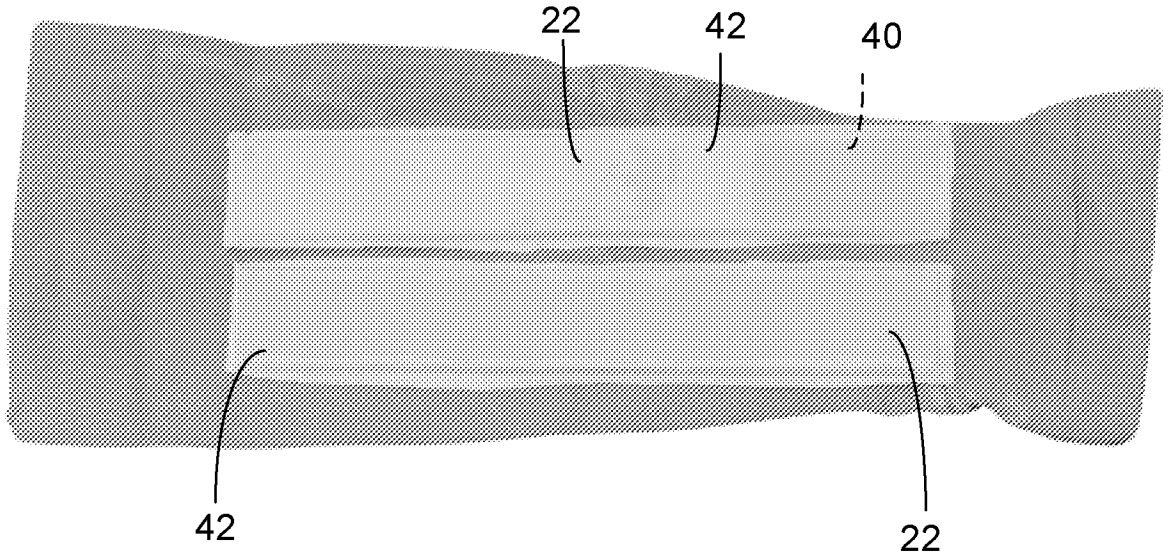
FIG. 4 illustrates a compression sleeve with multiple removable weights.

FIG. 3 and FIG. 4 illustrate embodiments of compression sleeves 10 with weights removed. As shown in FIG. 3, a single elongated weight may be used. The single elongated weight 22 may be disposed within a sheath 42. The sheath 42 may be a plastic covering or enclosure. In some embodiments the sheath may be a plastic coating. The sheath may assist in preserving the elongated weight protecting it from exposure such as exposure to moisture or contaminants. The sheath 42 also promotes the ability to readily clean the weight. In addition, the sheath may provide for additional insulation between metal which may be cold and the individual.

In some embodiments, the single elongated weight may be formed from the sheath 42 enclosing a plurality of weighted beads such as ball bearings, spheres, pellets, cylinders, or other small structures. Such a configuration is less rigid than a single piece weight.

FIG. 4 illustrates that more than one elongated weight 22 may be present. As shown in FIG. 4 two weights are present. Where two elongated weights 22 are present they may be spaced apart so that both of the elongated weights 22 may be positioned to run along a bone of the individual. For example, the weights may be positioned to extend along opposite sides of a shin bone.

The elongated weights 22 may be of different sizes and weights and may be made from different materials. In one embodiment, the weights may be around 5 inches (12.7 cm) long and may have varying thickness based on the weight desired. In other embodiments, the weights may be 7 inches (17.78 cm) long or 6 inches (15.24 cm) long. Weights may be, for example, ¼ inch (0.635 cm) thick and may, for example, have a width of 1.5 inches (3.81 cm). For example, weights may be around 13 ounces (368.5 grams), 11.7 oz (331.7 grams) or 6 oz (170.1 grams). However, other sizes and weights may be used and it is fully contemplated that varying weight sizes may be used. In addition, as shown in FIG. 4 multiple weights may be present.

Figure 5:
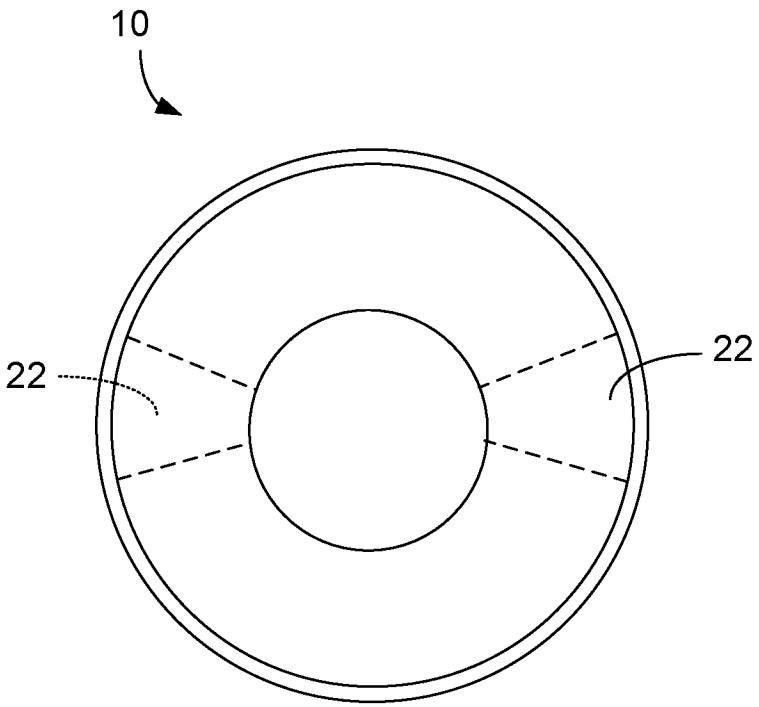
FIG. 5 is an end view of a compression sleeve with weights on opposite sides of the compression sleeve.

FIG. 5 illustrates a view of another example of the compression sleeve 10. In the example shown weights 22 may be positioned on opposite sides of the compression sleeve. For example, the weights 22 may be positioned on opposite sides of a shin bone as previously discussed. Where the compression sleeve 10 is an arm sleeve, the weights 22 may be positioned along opposite sides of the forearm. The weights 22 may be disposed within pockets which may be, for example, inner pockets with an opening, outer pockets with an opening, or sewn-in pockets without any openings. Positioning of the weights on opposite sides of the compression sleeve allows for equalized or balanced additional force to be applied to the individual. This may be appropriate for therapeutic purposes and/or to increase strength in a manner which avoids injury or undue stress and promotes balanced function.

Figure 6:
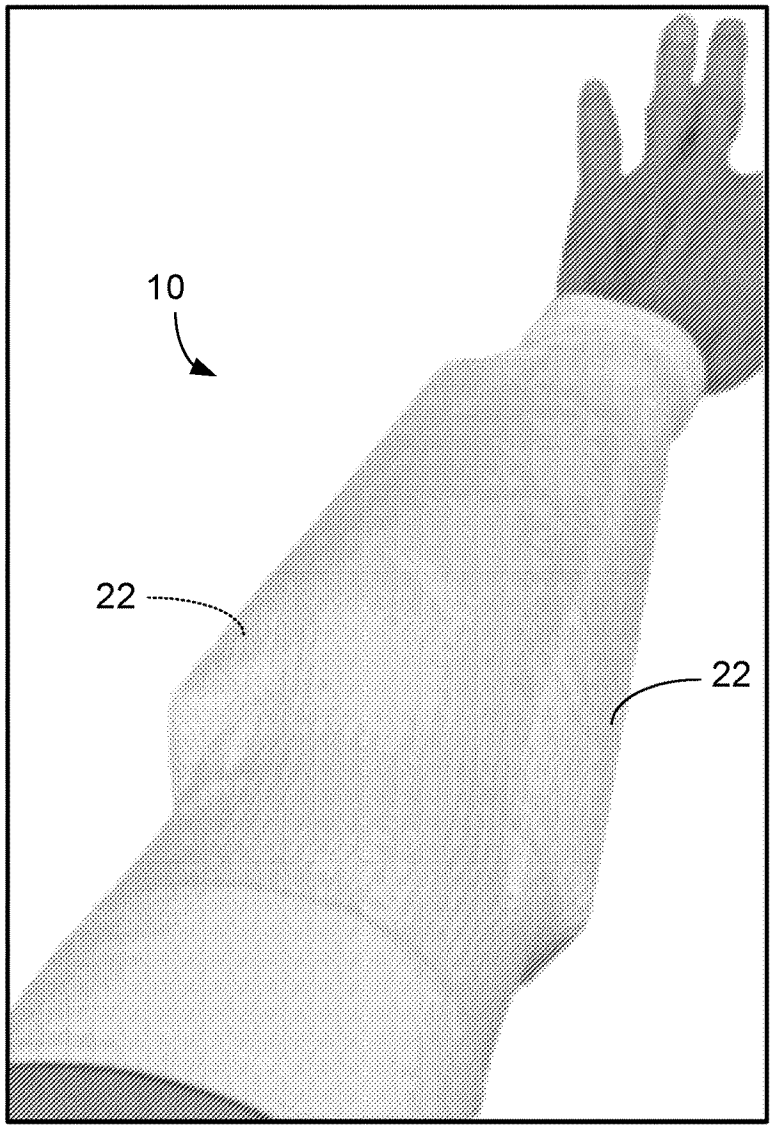
FIG. 6 illustrates a view of a compression sleeve with weights on opposite sides of the compression sleeve and fitted to a forearm of an individual.

FIG. 6 illustrates another example of the compression sleeve 10 fitted to the arm of an individual and further showing weights 22 positioned on opposite sides of the arm of the individual.

Figure 7:
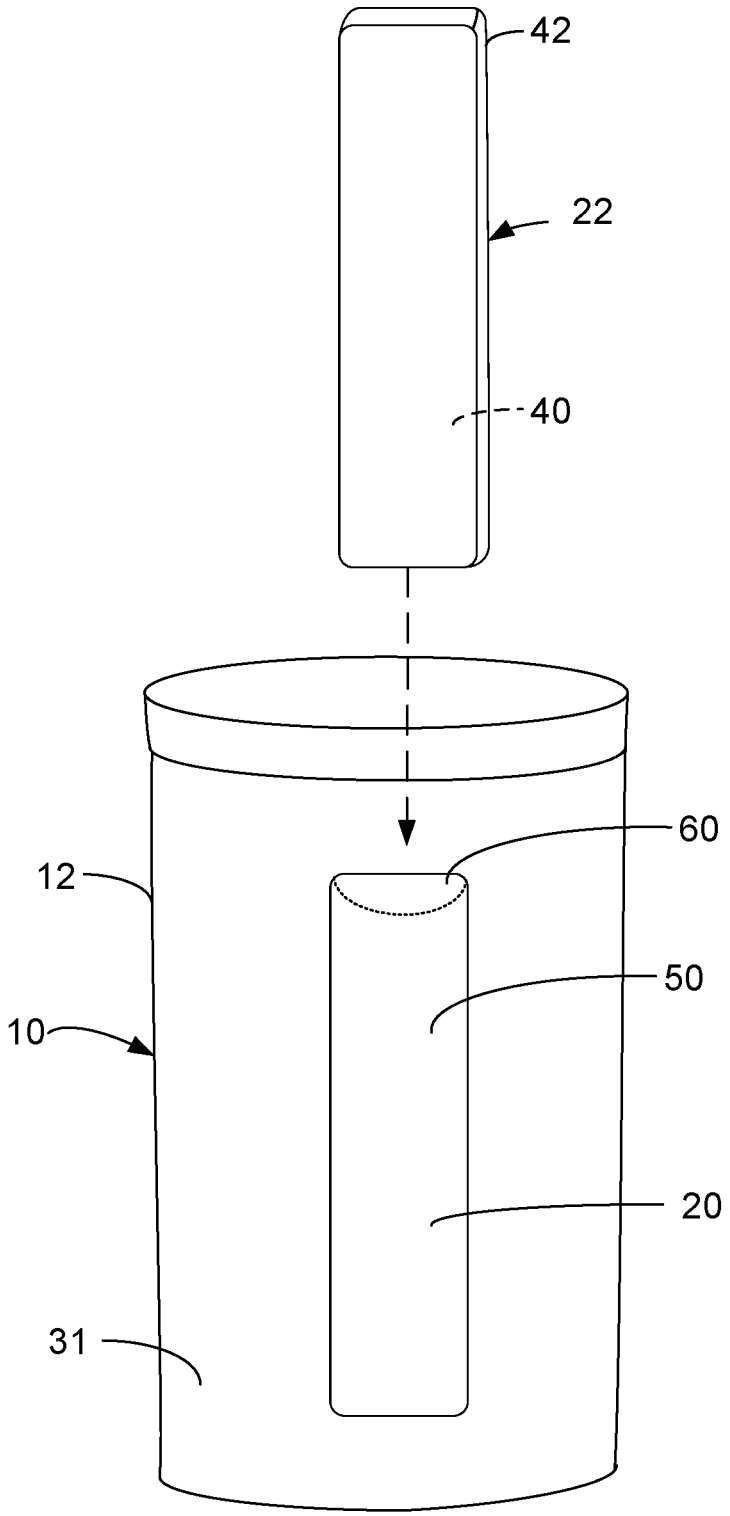
FIG. 7 illustrates a compression sleeve turned inside out so that the inside surface and its pockets are shown.

FIG. 7 illustrates one example of the compression sleeve 10 turned inside out so that the inside surface 31 of the compression sleeve 10 is visible. A pocket 50 is shown with an opening 60 at a top end of the pocket 50 for insertion of an elongated weight 22. The weight 22 may have a sheath 42 with a metal weight 40 disposed therein such as a bar formed from a metal alloy such as steel. The pocket 50 is sized and shaped so that an elongated weight 22 may be disposed therein. Preferably, the length of the pocket 50 is closely matched to the length of the elongated weight 22 so that the elongated weight 22 snugly fits within the pocket. Thus, if the elongated weight 22 is, for example, 5 inches, the pocket 50 will be around 5 inches in length.

The elongated weights 22 may be removed from the pockets so that the compression sleeve 10 may be used without the weights present and also so that the compression sleeve 10 may be cleaned.

Figure 8:
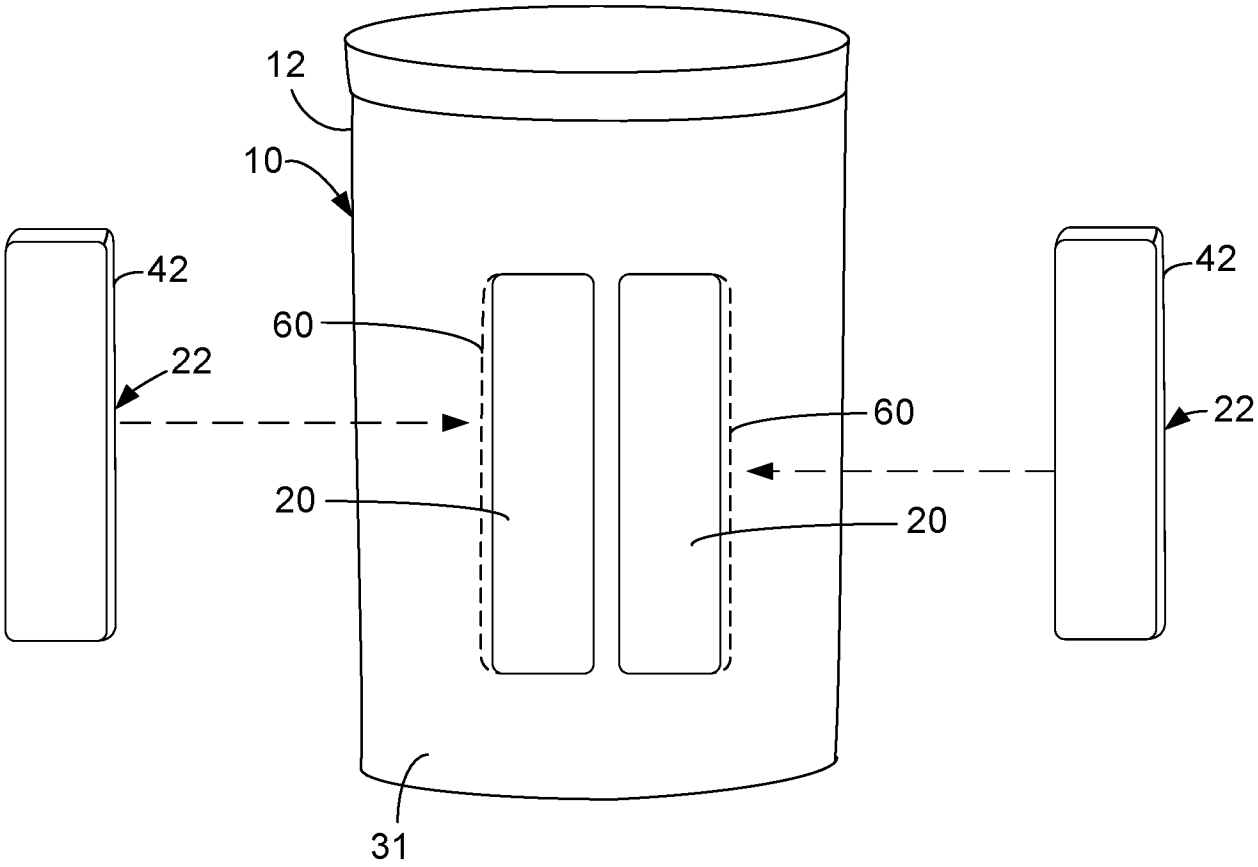
FIG. 8 illustrates another example of a compression sleeve turned inside out so that the inside surface and its pockets are shown.

FIG. 8 illustrates another example of the compression sleeve 10 turned inside out so that the inside surface 31 of the compression sleeve 10 is visible. Two elongated pockets 20 are shown each with an opening 60. The openings 60 are shown on outer sides of the elongated pockets 20. Although top openings such as those shown in FIG. 7 for the pocket may be preferred, it is to be understood that pockets may be positioned in other locations to provide access to the interior of the elongated pockets 20 for insertion or removal of the elongated weights 22. Depending upon type of physical activity, sleeves may be beneficial to socks as they may allow for greater mobility, however, both are contemplated.

Figure 9:
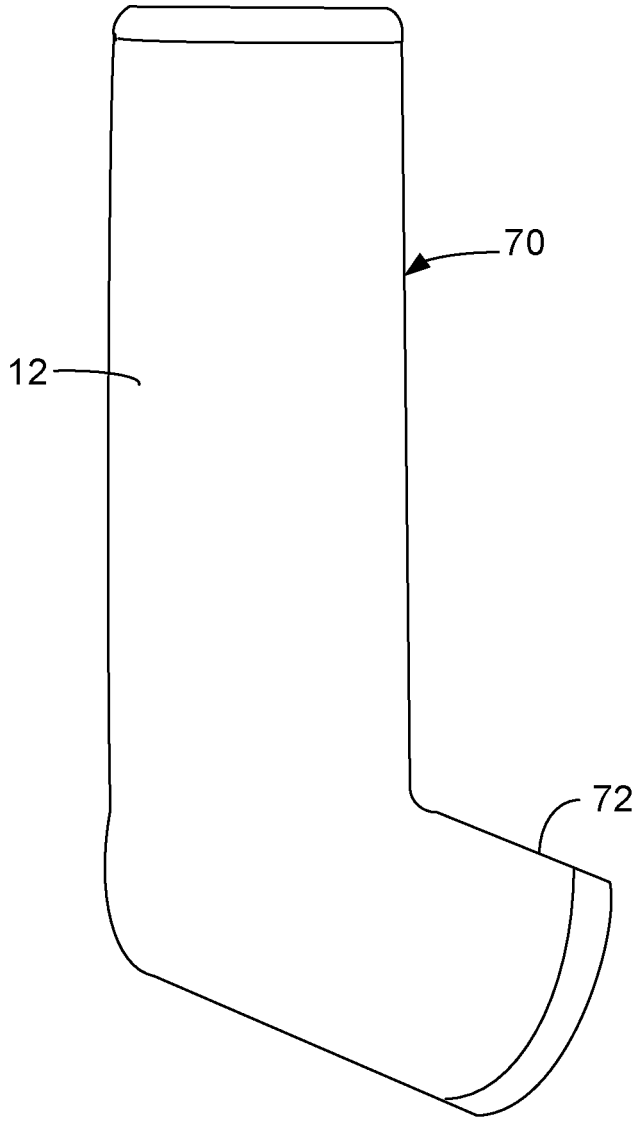
FIG. 9 illustrates another example of a compression garment in the form of a compression sock without toes.

FIG. 9 illustrates another example of a compression garment in the form of a compression sock 70, in this case without toes. The compression sock 70 may include the compression sleeve body 12 but with added material to include a foot covering area 72 which is open toed.

Figure 10:
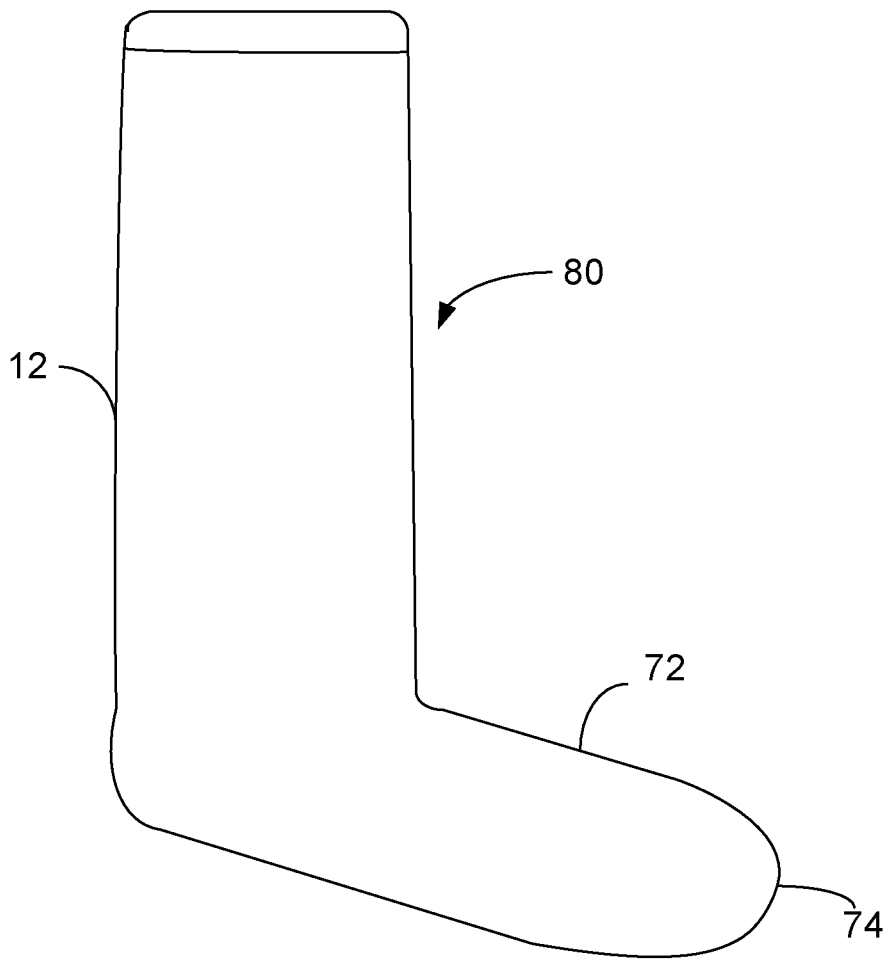
FIG. 10 illustrates another example of a compression garment in the form of a compression sock.

FIG. 10 illustrates another example of a compression garment in the form of a compression sock 80. The compression sock 80 may include the compression sleeve body 12 with added material to include a foot covering area 72 and a toe covering area 74.

Figure 11:
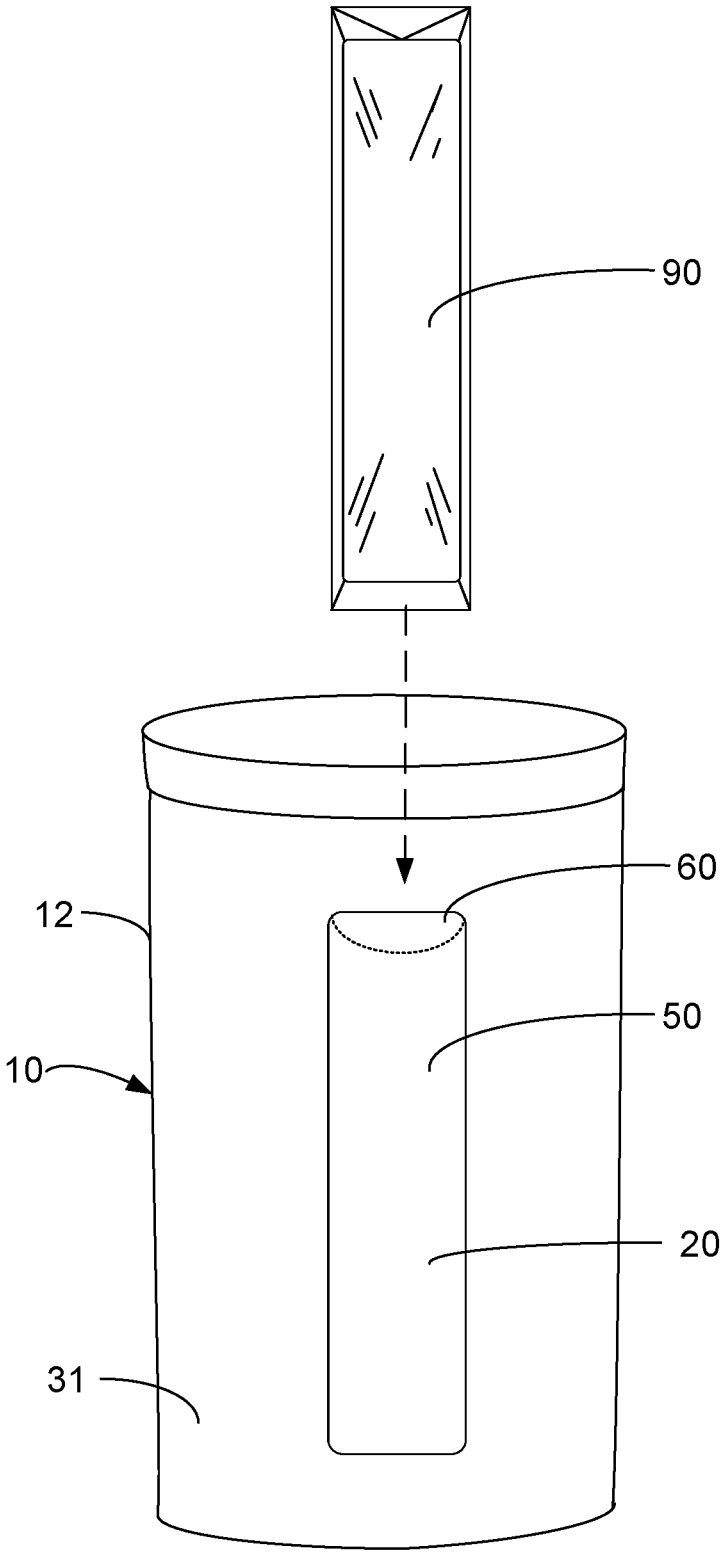
FIG. 11 illustrates the compression sleeve of FIG. 5 with a heat pack shown instead of a weight.

FIG. 11 illustrates the compression sleeve of FIG. 7 with a heat pack 90 shown instead of a weight. The compression sleeve may be used in several different ways. The compression sleeve may be used in a conventional way where nothing is placed in the pocket 50. Alternatively, weights may be placed in the pocket. However, in another configuration, a heat pack 90 may be placed in the pocket. The heat pack 90 may be a chemical heat pack which may be suitable for providing heat therapy. One example of such a chemical heat pack provides for dissolving calcium chloride into water. Another example of a chemical heat pack provides for dissolving magnesium sulfate into water. Of course, any number of chemical heat packs may be used which may use any number of different chemical reactions. The pocket 50 of the compression sleeve provides for separation between skin of an individual and chemical heat pack which assists in protecting the skin of the individual from direct contact with the chemical heat pack and in preventing burns.

The heat pack 90 is beneficial in a variety of situations. For example, the heat pack 90 may be used to provide heat therapy as previously explained, for example, the heat pack 90 may assist in soothing aching muscles and joints, relax tight muscles, increase blood flow in order to reduce stiffness and increase elasticity of ligaments and tendons. The heat pack 90 may be beneficial where the individual is engaged in activity to help increase blood flow or to provide warmth. For example, an athlete or active person could wear the compression sleeve 10 with the heat pack 90 present outdoors when the temperature is low in order to help maintain warmth or to help prevent injury that may be more likely to occur because of cold temperatures.

The heat pack 90 may be disposable so that after use, the heat pack 90 may be removed from the compression sleeve 10 and discarded. If desired, a new heat pack may be inserted into the pocket 50 instead. Although chemical heat packs are preferred, it is contemplated that other types of heat packs may be used. These may include microwavable heat packs. In addition, it is contemplated that cold therapy may be provided by cold packs.

Figure 12:
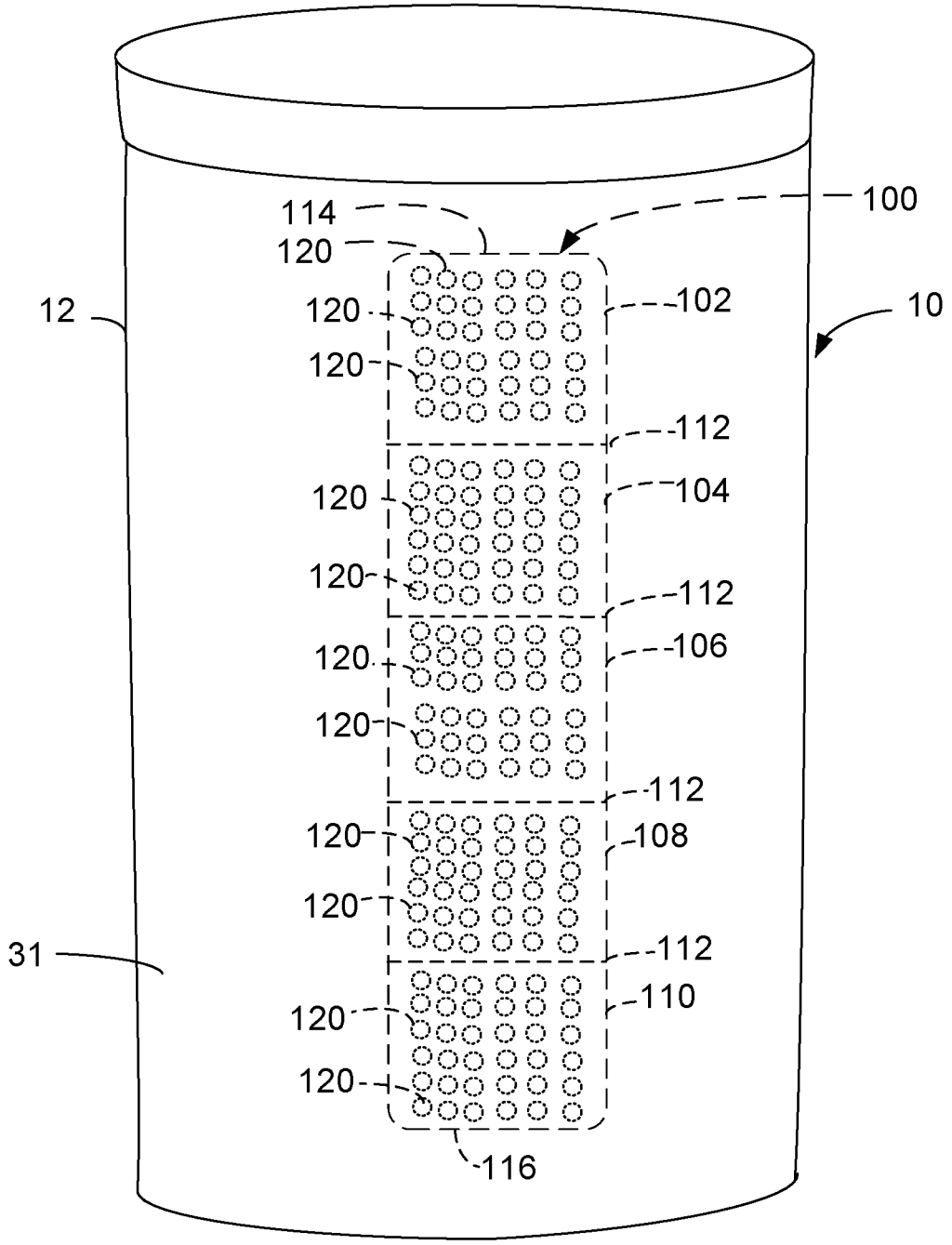
FIG. 12 illustrates a compression sleeve where weights are embedded within the compression sleeve.

FIG. 12 illustrates a compression sleeve where weights are embedded within the compression sleeve. A pocket 100 is shown which may include a plurality of compartments 102, 104, 106, 108, 110. Within each of the compartments a plurality of weights 120 may be present. The weights may be of various sizes or shapes. For example, the weights may be weighted beads which may be small cylinders or spheres such as ball bearings, pellets, or of other geometries. Having small items allows for some movement of the weights to allow for distribution of the weights and enhanced movement of the individual while also enhancing comfort of the individual. Preferably, the weights are rust-proof and may be formed from a metal or metal composite. In some embodiments the weights may be made moisture proof through coating such as with a plastic or rubber material. In some embodiments the pocket 100 and/or each of the compartments 102, 104, 106, 108, 110 is lined with a moisture proof or moisture resistant material.

The pocket 100 has a top portion 114 and a bottom portion 116. There may be separators 112 between adjacent compartments within the pocket 100. In some embodiments, the separators 112 prevent movement of the weights 120 between adjacent compartments. In some embodiments, the separators 112 may be formed from stitching. This configuration allows for the weights to maintain a desired weight distribution between pockets while still allowing for some movement of the weights within the same compartment in order to better adapt to the body or movement of the user and enhance comfort while avoiding having all of the weights amassed at the same location.

In some embodiments, the weighted beads 120 may be sized, shaped and position, that an individual may massage the area such that the presence of the weighted beads are pushed into the body of the individual to increase blood flow which may have therapeutic benefits for the individual.

Figure 13:
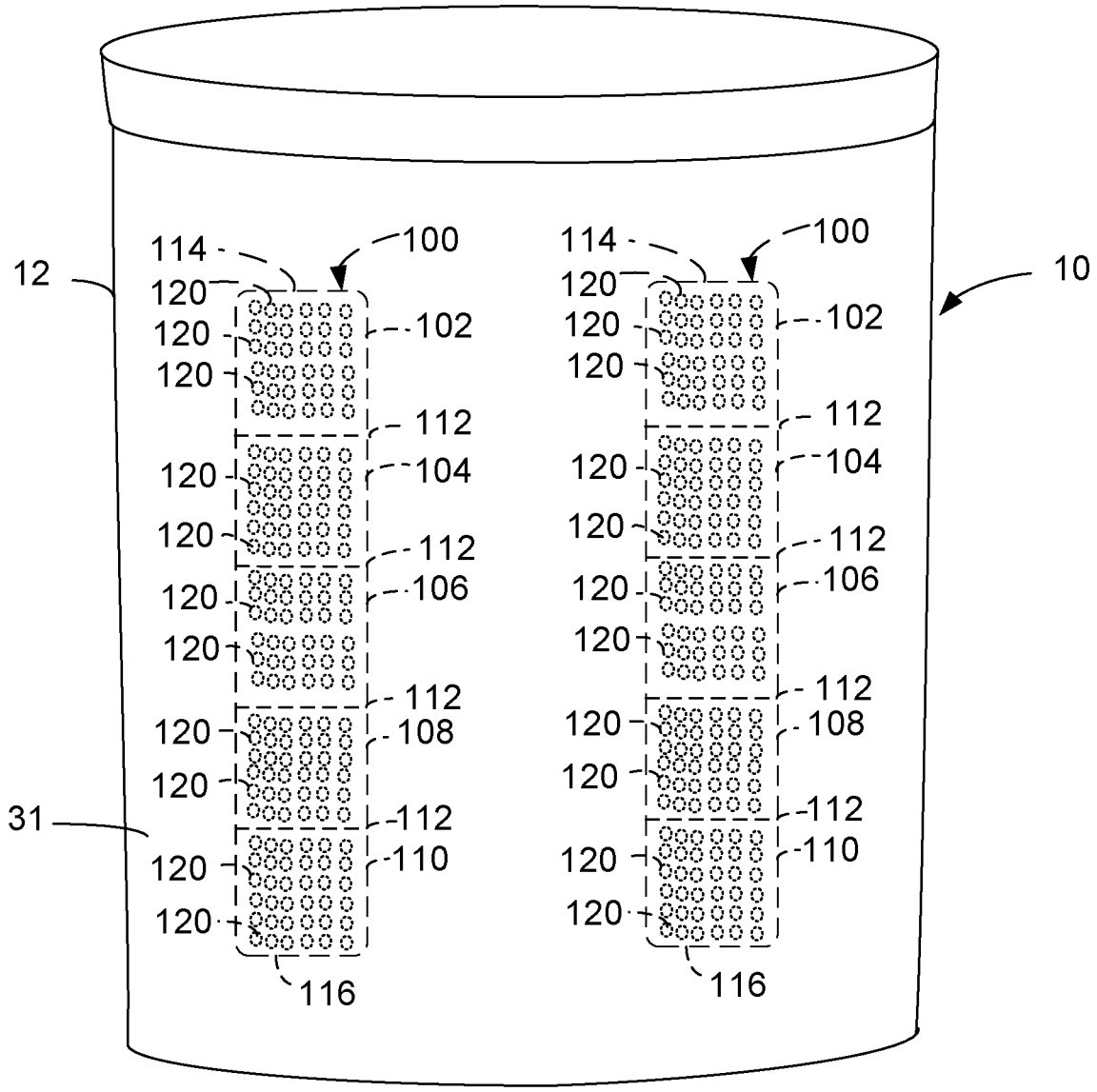
FIG. 13 illustrates another example of a compression sleeve with weights with multiple pockets of weights.

FIG. 13 illustrates another example of a compression sleeve with weights with multiple pockets of weights. Note that one or more pockets 100 may be present which may be spaced apart and that each of the pockets 100 may have its own set of compartments.

Figure 14:
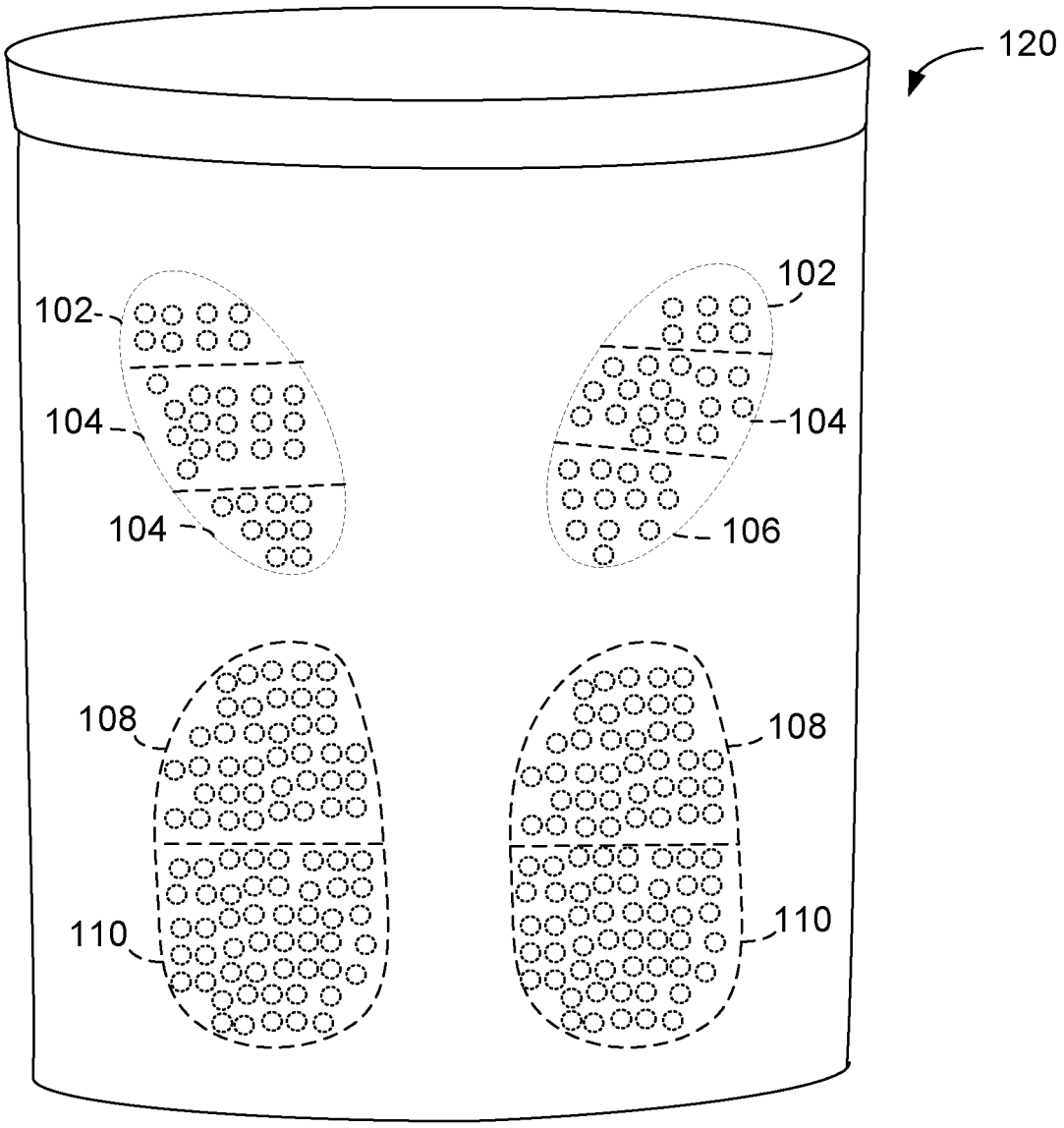
FIG. 14 illustrates another example of a compression sleeve with weights with multiple pockets of weights in different geometries.

FIG. 14 illustrates another example of a compression sleeve with weights with multiple pockets of weights in different geometries. Note that the pockets may be of different size, shapes, and orientations and may contain different weighting. Each of the pockets may have multiple compartments. In some embodiments, the size, shape, number of pockets, and weighting may be selected based on the needs or preferences of a particular individual and their specific needs for strengthening whether part of a therapeutic program, physical therapy program, or strength training to enhance sports performance.

In some embodiments, the pocket 100 for the weighted beads may be an outside pocket which may be stitched shut such that the weighted beads are further away from the body, however, it may be preferred that the weighted beads are within an inside pocket which may be stitched closed such that the weighted beads are closer to the body of the individual.

It is to be understood that where a sleeve has multiple pockets, pockets may be configured differently. For example, for an arm sleeve, one pocket may be positioned on an outer part of a forearm of individual facing away from their body and a second pocket may be on an inner side of the forearm facing the body. Similarly, for a calf sleeve, one pocket may be positioned on an outer part of the calf of an individual facing away from their body and a second pocket may be on an inner side of the calf facing the body. Similarly, for a sock sleeve, one pocket may be positioned on an outer part of the individual facing away from their body and a second pocket may be on an inner side facing the body. In other embodiments weights may be positioned different. For example, for a compression sleeve or garment fitting over a thigh, there may be two pockets on an outer portion of the thigh and no pockets on an inside portion of the thigh to avoid potential for discomfort.

Figure 15:
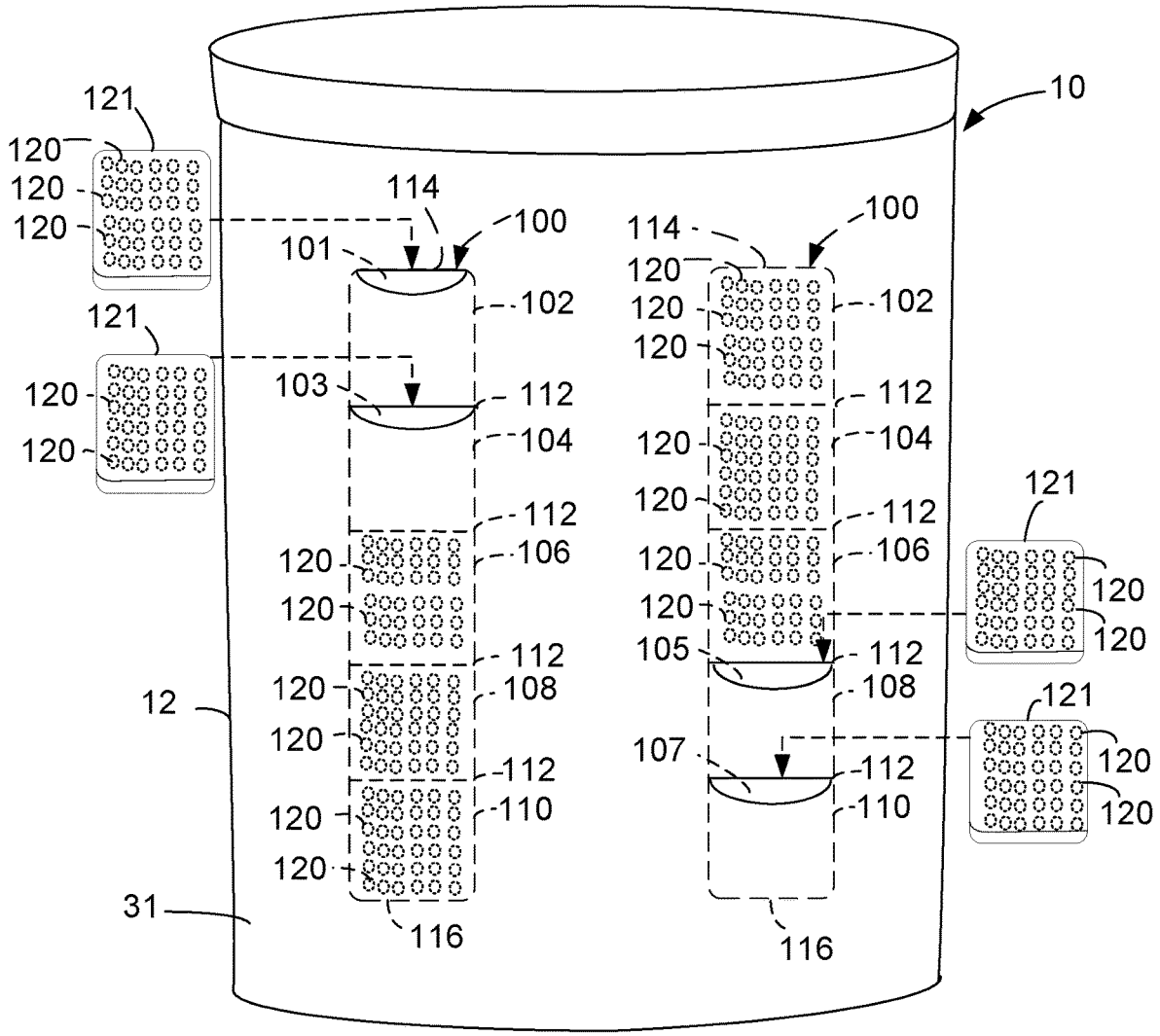
FIG. 15 illustrates an example of a compression sleeve with both permanent weights as well as pockets for inserting additional weights.

It should also be understood that in some embodiments there may be multiple pockets some of which may provide for permanent enclosure of weights and others of which may provide for removable weights. FIG. 15 illustrates one example. As shown in FIG. 15 there are compartments 106, 108, 110 and 102, 104, 106 which may be stitched shut or otherwise permanently secure which may contained weighted beads 120. In addition there may be pockets 101, 103, 105, 107 which each may accommodate one or more weighted containers 121. Each weighted container may be made from a pliable material such as fabric or plastic and may contain weighted beads. Each weighted container may be a pouch or bag and may seal weighted beads within. Different weighted containers may have different weights such as may be achieved by increasing the number of weighted beads or otherwise increase the weighting within the weighted container.

As shown in FIG. 15, the overall weight associated with the compression sleeve is based on a combination of weights which are more permanently affixed or positioned within the compression sleeve in addition to removable weights. Thus, for example, over the course of a therapeutic treatment program or a physical therapy program or a progressive resistance strength or conditioning program, an individual may begin the program with an initial weight and then add additional weight.

The pockets 101, 103, 105, 107 may be positioned on the outside of the compression sleeve or on the inside of the compression sleeve. In some embodiments, heat packs may be placed inside one or more of the pockets 101, 103, 105, 107. In some embodiments, more or fewer pockets may be used. Pockets may be positioned in different positions. It should also be understood that in some embodiments, one pocket or more pockets may be inner pockets and one pockets may be an outer pockets.

Another advantage of having multiple and smaller pockets is that it provides additional flexibility in placement and positioning of the weights (or heat packs). Thus, in some embodiments there may be significantly more pockets and pockets may be placed throughout the compression sleeve so that a health care provider, physical therapist, trainer or other may position the weights in the best location to optimize results from a therapy or training program.

Thus, various embodiments of weighted compression garments have been shown and described. It is further to be understood that additional types of weighted compression garments may be provided such as weighted compression sleeves for the arms which may extend further past the elbow. Similarly it may include compression garments which reach over the knee. It is to be further understood that based upon the particular individual, their physiology, the physical activity which they would like to improve, and other considerations such as mobility, different variations or options may be appropriate. Suck as calf compression sleeves, knee compression sleeves, ankle compression sleeves, arm compression sleeves, elbow compression sleeves, and other types of compression garments.

The compression aspect of the present invention allows for advantages associated with compression sleeves to be realized. This may include applying pressure so as to limit fluid buildup. Thus, wearing compression sleeves can assist in reducing swelling and pain. In addition, wearing compression sleeves may assist in enhancing blood flow to affected muscles thereby providing enhanced levels of oxygen which may result in delayed tiredness. In some activities, such as running, compression may also help attenuate effects of vibrations.

It is to be further understood that the outside surface of the compression sleeve body may have a color or pattern selected to enhance the desirability of the compression sleeve. For example, the compression sleeve body may include colors, patterns, logos, words, or images associated with sports teams, businesses, sponsors, or other branding. In some embodiments, the placement of such branding or design elements may relate to the structure of the compression sleeve. For example, design elements may be placed on the outside surface over one or more pockets in order to obscure the presence of the pockets and the weights in the pockets. Alternatively, design elements may be constructed and positioned to accentuate the presence of the pockets and of the weights in the pockets. For example, areas over the pockets may have a different color than neighboring areas of the surface of the compression sleeve.

The outside surface of the compression sleeve may also include design features which are functional in nature. For example, reflective surfaces may be present on the compression sleeve to enhance safety. Alternatively or in addition, the compression sleeve may include fluorescent fabric which emits light in the dark after being charged by exposure to light. Such an outside surface may be both decorative as well as functional in that it enhances safety for an individual wearing the compression sleeve in the early morning or evening when it is dark.

It is contemplated that the compression sleeves may be used in a manner to promote or enhance or improve physical performance or fitness. One use case is to enhance athletic performance. In such a use, appropriately weighted compression sleeves may be used during practice or training. Added weight as a part of training will allow the athlete to strengthen their body and move more quickly during competition while also enhancing blood flow, delaying the onset of tiredness. Thus, the benefits of compression sleeves and weighted exercise provide a synergistic affect.

The compression sleeves may be used to enhance or improve physical performance in any number of different sports activity such as without limitation: football, basketball, baseball, volleyball, beach volleyball, softball, cross country, field hockey, ice hockey, fencing, bowling, golf, lacrosse, soccer, gymnastics, water polo, tennis, skiing, track and field, swimming, wrestling, boxing, martial arts, and others.

The compression sleeves may also be used to assist with rehabilitation such after a sports related injury in order to build up strength and speed while also maintaining enhanced blood flow, reducing pain, or otherwise providing the benefits of compression sleeves.

The compression sleeves may also be used in any number of other situations including by those with an active lifestyle including the elderly. In such a use, there are many potential advantages. In addition, to the benefits generally associated with wearing compression sleeves such as enhanced blood circulation, the combination with weights is advantageous. The individual is able to obtain the benefits of weighted exercise in a handsfree manner. Thus, it may be safer for an elderly individual to use weighted compression sleeves as opposed to using dumbbells. In addition, the elderly individual would be able to hold a phone, a drink, or other item. It is further to be noted that when the weights are removed from a compression sleeve, the compression sleeve may still function as a compression sleeve.

As mentioned herein, the compression sleeves have a number of options and variations. In addition, the compression sleeves may function in several different ways. This includes as normal compression sleeves in the conventional manner, as weighted compression sleeves when one or more weights is present in one or more pockets of the compression sleeves, as heated compression sleeves when one or more heat packs is present in the compression sleeves. Thus, the same compression sleeve may be used with weights of different sizes, with heat packs, or otherwise.

The present invention contemplates methods of performing physical therapy, rehabilitation, or other types of training or treatments using one or more compression sleeves, weights, and/or heat packs. Depending upon individuals needs as may be determined through appropriate assessments a health care provider such as a medical doctor or physical therapist may select an appropriate compression sleeve for the individual. Selection of the appropriate compression sleeve may involve size, type (such as sleeve or sock), number and placement of pockets, and number and size of weights or heat packs.

A treatment plan may specify exercises to perform, sets and repetitions for the exercises, or a time duration for performing the exercises. The treatment plan may specify the weights to use and positioning of the compression sleeve. In some embodiments, the treatment plan may specifically identify the placement of the weights and/or heat packs. The treatment plan may be progressive in nature in that over time the amount of weight may change and/or the placement of weight may change. Different exercises may also involve different amounts of weights and different placement of weights. The amount and placement of weights may be communicated to an individual in different ways, such as by indicating on a graphical representation of the compression sleeve which pockets are to be used for weight, which for heat, and the amount of weight. Such a graphical representation may be presented on paper or electronically.

According to another aspect, a web site is provided which facilitates customization or building of compression sleeves according to a purchaser's preferences. This may include the type or style of compression sleeve, the colors used in a compression sleeves, the number of pockets. This may further include functionality for including logos including user uploaded logos or other images. This customization may further include the number of weights and/or heat packs.

Figure 20:
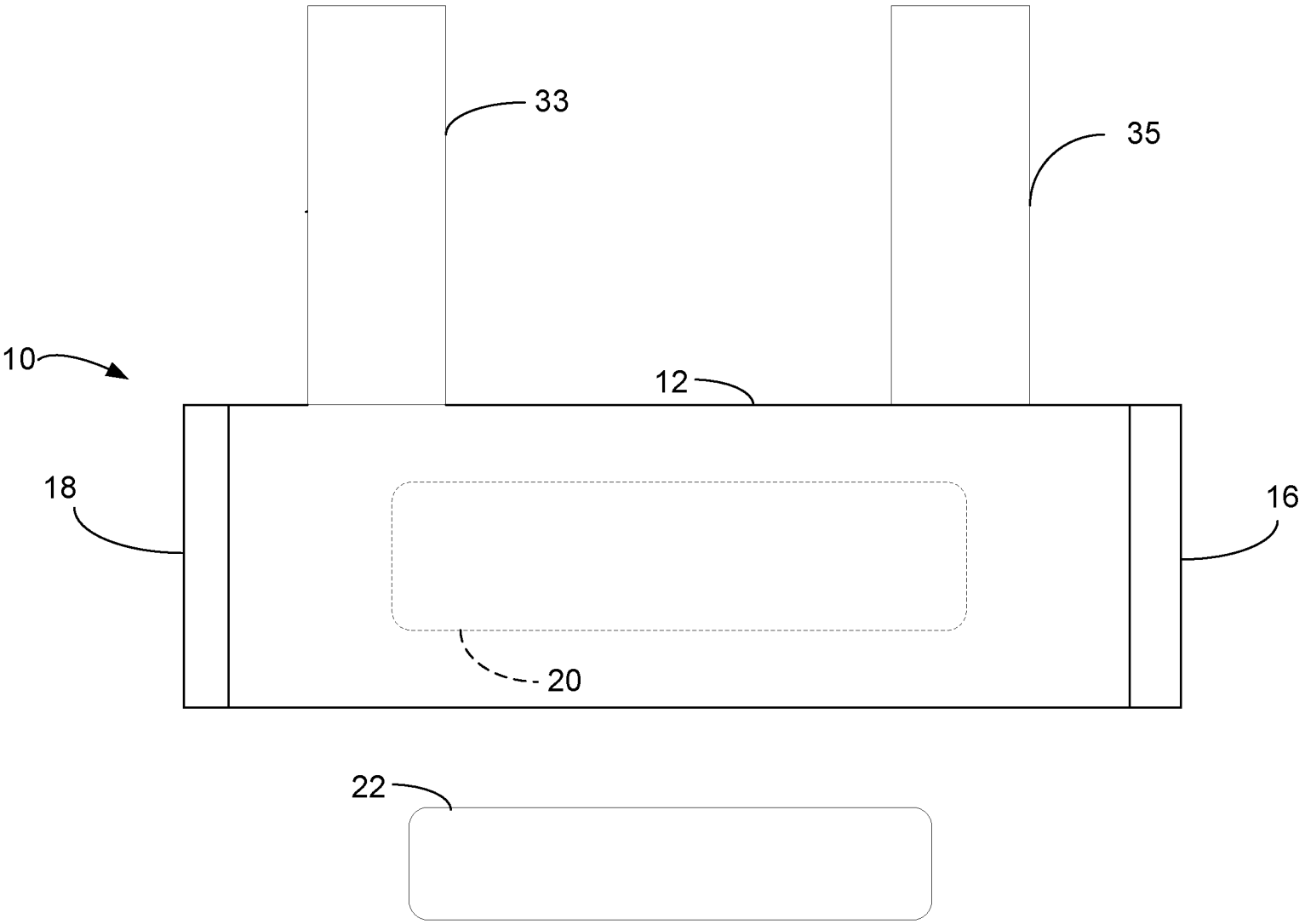
FIG. 20 further illustrates the compression sleeve with straps present.

Turning to FIG. 20, another example of a weighted compression sleeve 10 is shown which has a compression sleeve body 12 having a superior opening 16 and an opposite inferior opening 18 for fitting to a body part. An elongated pocket 20 is shown in which weight 22 may be positioned. Straps 33, 35 are also shown which may be wrapped around a body part and secured in place such as with a hook and loop fastener such as VELCRO.

Figure 21:
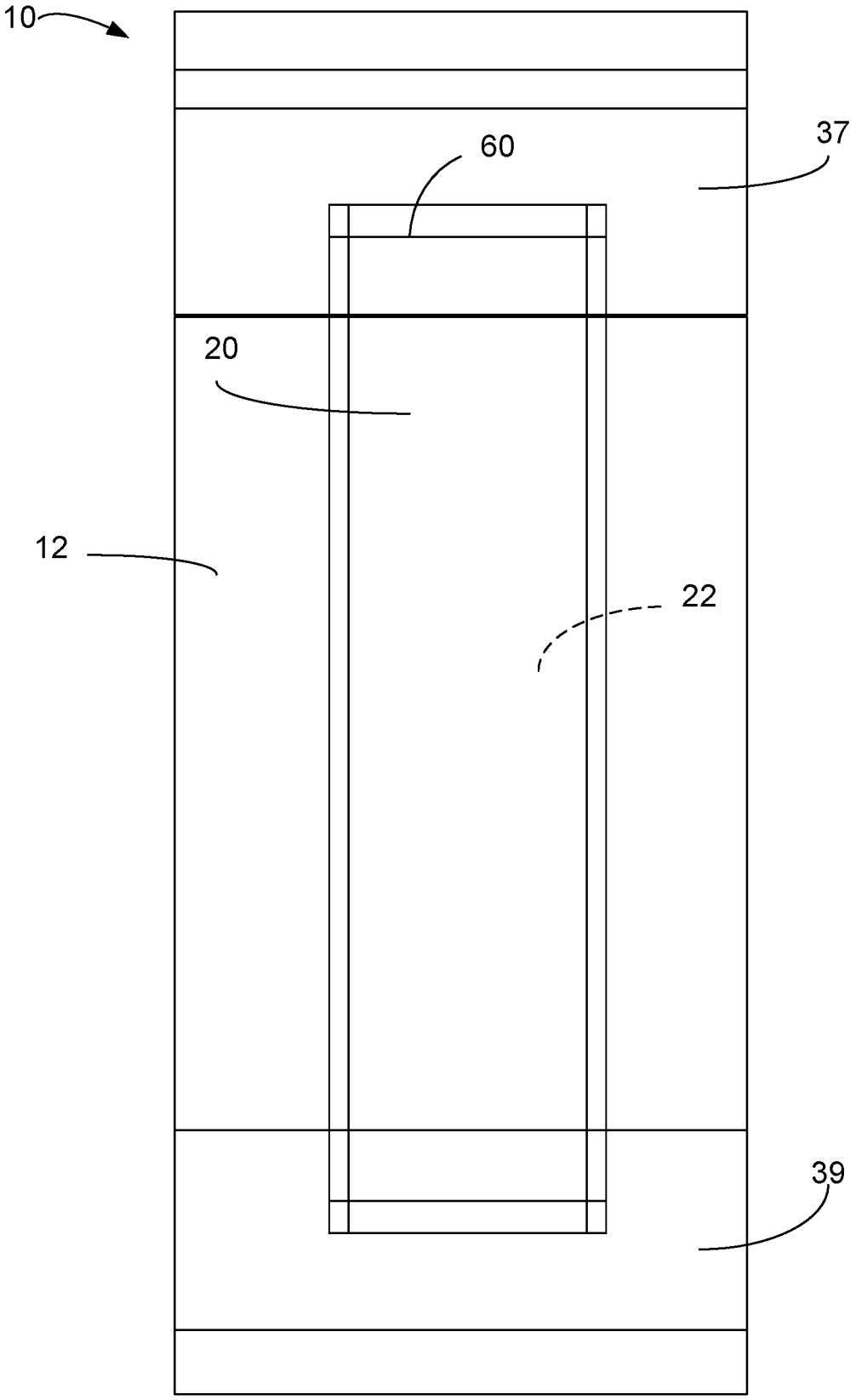
FIG. 21 is another view of the compression sleeve for use with straps.

FIG. 21 illustrates another view of the weighted compression sleeve 10 of FIG. 20. Hook and loop fastener areas 37 and 39 are shown on the compression sleeve body 12. A weight 22 may be placed in the pocket 20. Preferably, the pocket 20 has an outside opening 60 at top portion of the pocket. The pocket 20 may be formed by stitching. Any of the various embodiments may include the hook and fastener areas and the straps for securing the weighted compression sleeve 10 to a body part.

Figure 16:
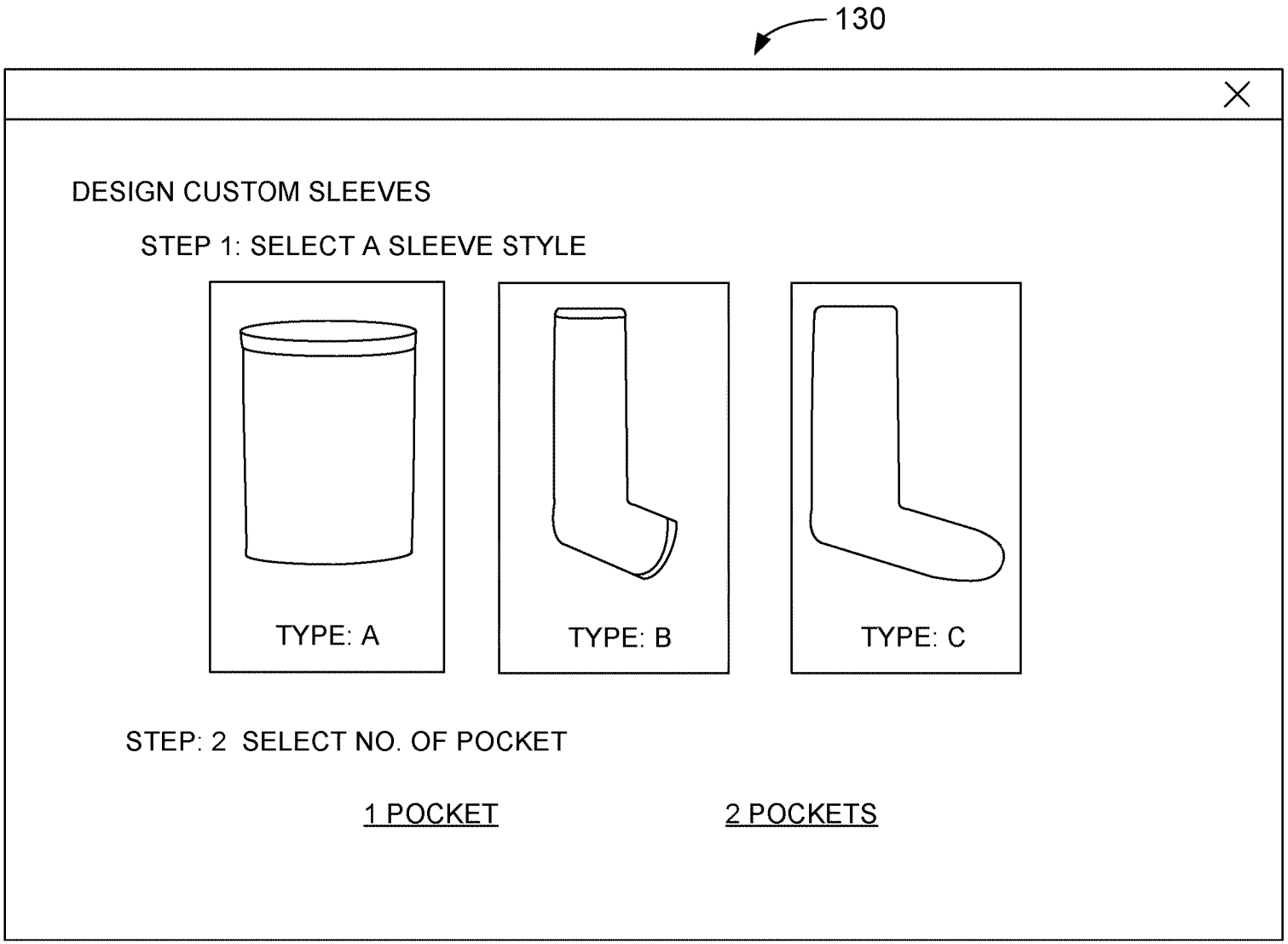
FIG. 16 illustrates one example of a screen display for designing custom compression sleeves.

FIG. 16 illustrates one example of a screen display 130 which may form a part of a user interface which allows a user to design and order one or more customized sleeves. For example, a user may select the type or style of sleeve they wish to order and then select the number of pockets. In some embodiments, the type or style of sleeve may include the placement, style, geometry or configuration of one or more pockets.

Figure 17:
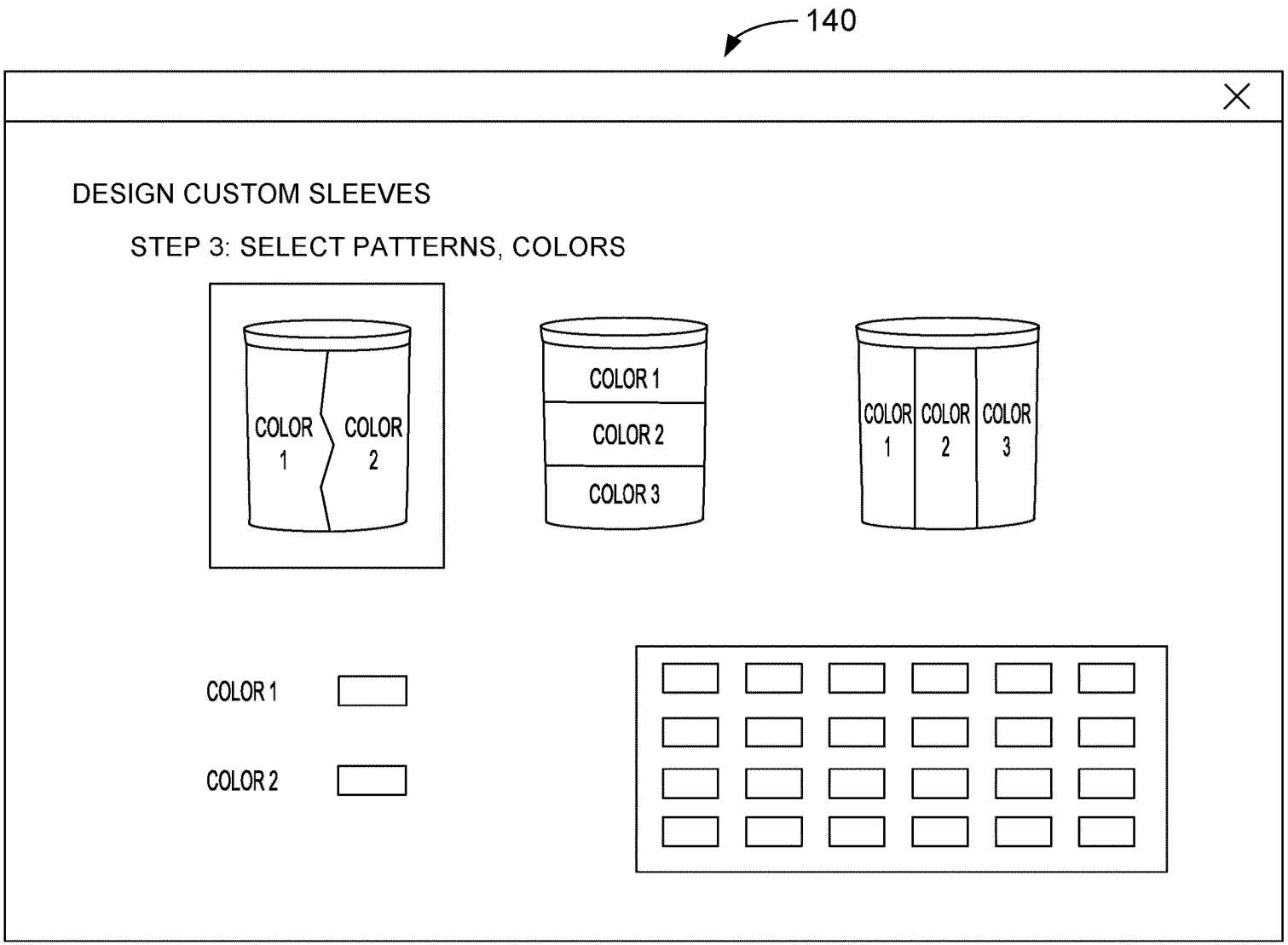
FIG. 17 is another example of a screen display for designing custom compression sleeves.

As shown in FIG. 17, a screen display 140 may allow a user to select patterns or colors. Although a few examples of representative patterns or designs are shown it is to be understood that any number of different patterns or designs may be used and any number of different colors may be used.

Figure 18:
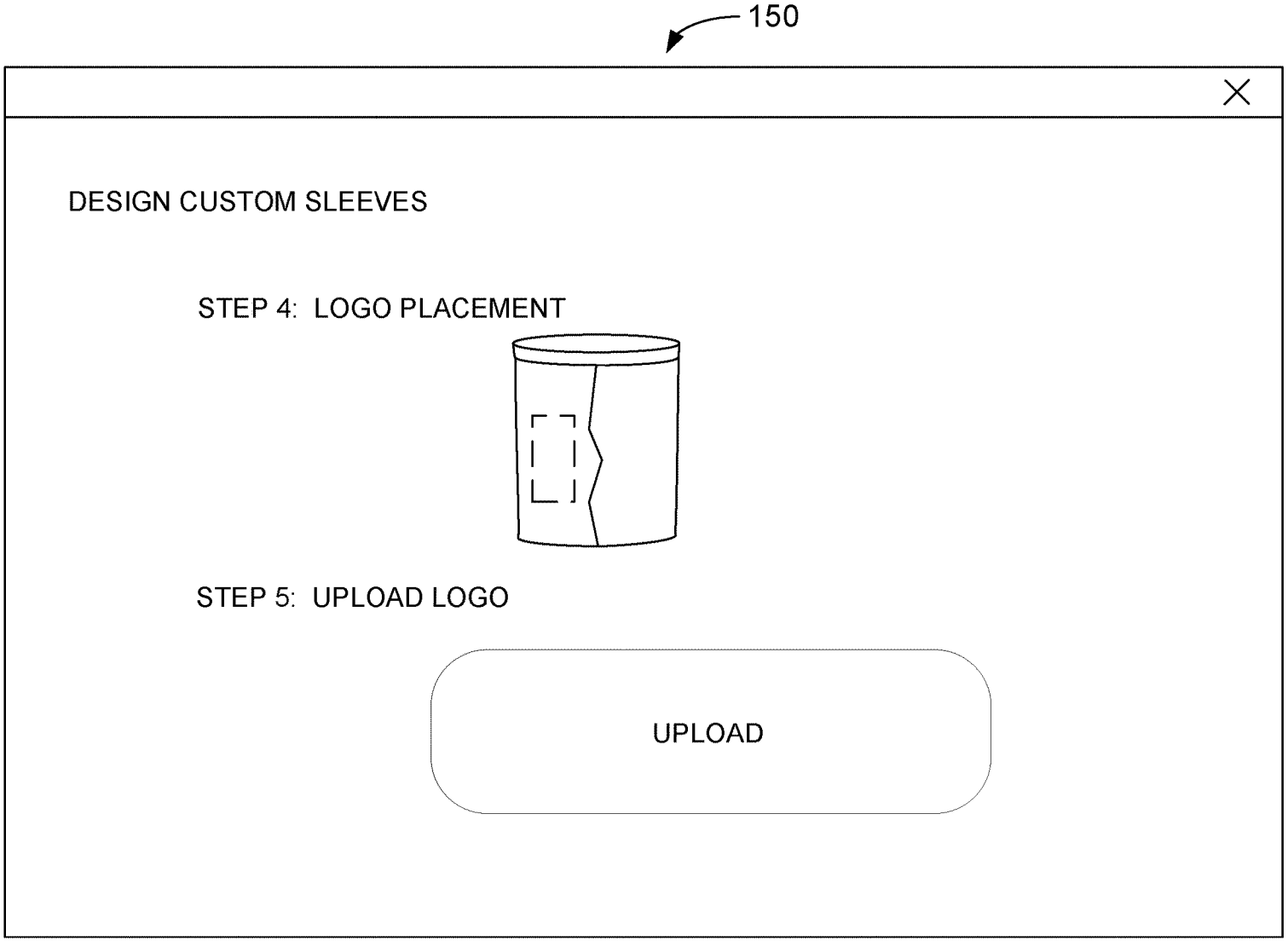
FIG. 18 is yet another example of a screen display for designing custom compression sleeves.

FIG. 18 is a screen display 150 where a logo may be placed in one or more areas of a design for a compression sleeve. It is contemplated that a user may be able to upload their own logo and/or select from other available logos or images.

Figure 19:
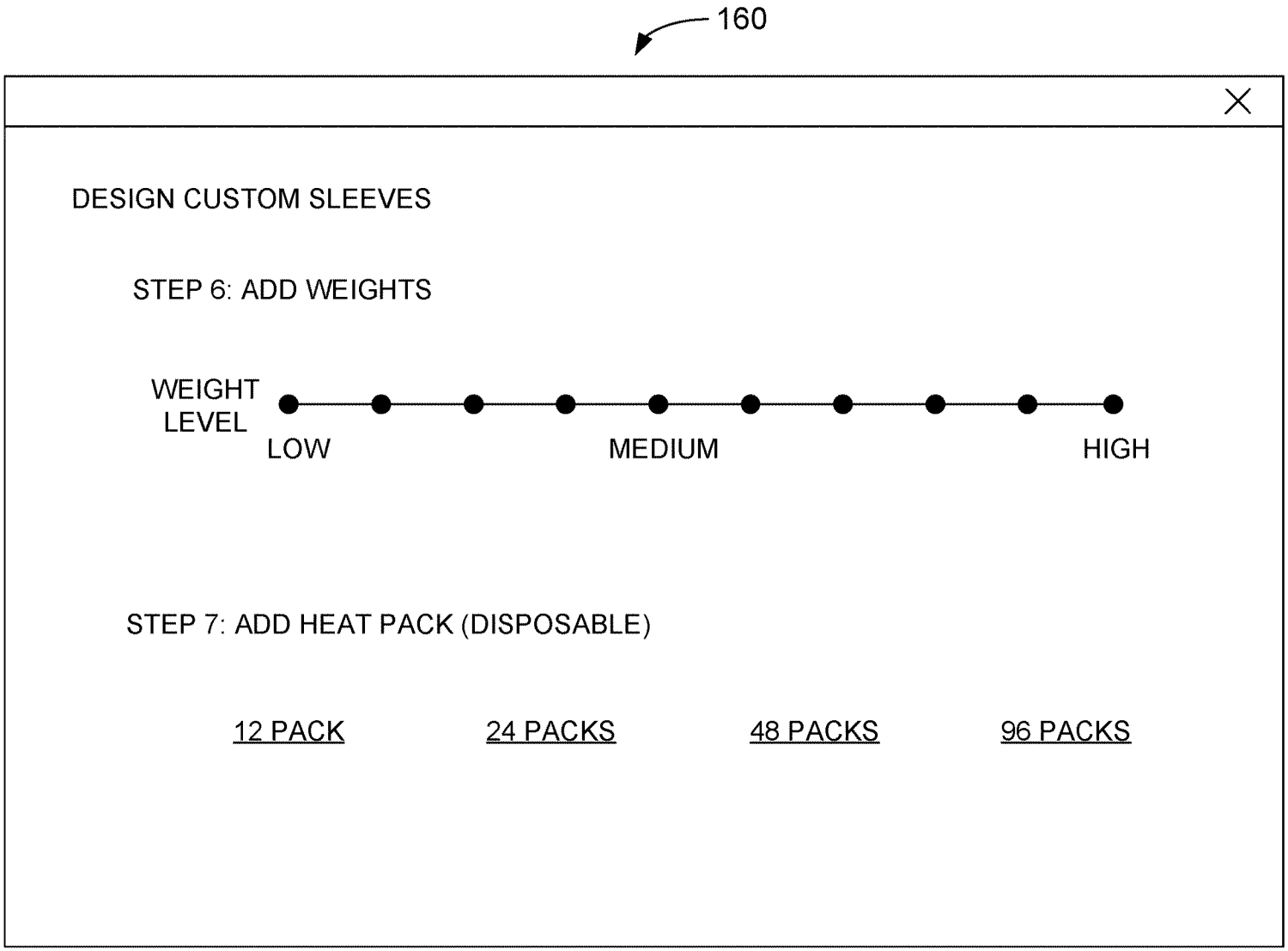
FIG. 19 is yet another example of a screen display for designing custom compression sleeves.

FIG. 19 is a screen display 160 which allows a user to specify additional information about their customized compression sleeve. This may include sizing the weights they wish to include, selecting heat packs, or otherwise adding to the customization or ordering process. This may further include whether or not the weights are sewn into the sleeve or whether the pocket is easily opened and closed. This may further include selecting the type of weight, such as whether the weights are beaded weights or made from solid, one-piece, integral materials. Once all necessary or optional selections have been made, an order may be constructed for a desired number of compression sleeves and related components. The order may be sent over a telecommunications network.

Although various functionality is shown in FIG. 16 through FIG. 19, it is to be understood that what is shown is merely representative and numerous other variations are contemplated including with respect to the specific user interface, the customization features, and the additional features. Thus, custom sleeves may be made for school teams, club teams, league teams, or other groups. Custom sleeves may be for health care providers to provide to their patients, for senior living facilities to provide to their residents, or for other very specific purposes. Individuals may create their own compression sleeves for their own individual use such as to coordinate with team colors, to coordinate with clothing or shoes, or for other purposes.

In addition, the user interface shown may be incorporated into a web site, a web application, a mobile application, or other application or software program. Software instructions executing on one or more processors of a computing device may be performed to generate the user interface and to receive input from the user. Instructions may also be stored on a computer readable storage medium. Presentation of the user interface such as displaying the user interface or receiving user input or user selection may be performed in any number of different ways.

In some embodiments the user interface may receive additional information. For example, a health care provider may provide an individual with a code to use when ordering a compression sleeve that defines the type, number of weights, or heat pack and other information so that the user need only enter the code to make certain selections and may then complete customization according to their preferences. The code may be a text code, a QR code, or other type of code. Alternatively, a health care provide can provide an ordering link. Thus, the health care provider can provide the compression sleeve to an individual at a hospital, office, or clinic or may provide the compression sleeve to the individual by sharing with the individual the information required to obtain the compression sleeve.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the disclosure. This description should be read to include one or at least one and the singular also includes the plural unless it is obvious that it is meant otherwise.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Therefore, a compression garment such as a compression sleeve or compression sock has been shown and described with numerous options, variations, and alternatives. The present invention is not to be limited to the specific embodiments described herein as the present invention contemplates differences in particular type of garments, different in the number of weights present, differences in the mass of the weights, differences in the size and shape of weights, differences in the types of materials used including types of elastomeric fabric and differences in type of metal alloy, differences in positioning of the pocket, differences in the positioning of the opening of the pocket, and other differences.

What is claimed:

1. A compression sleeve, comprising:

a compression sleeve body having a superior opening and an opposite inferior opening for fitting to a segment of a limb, wherein the compression sleeve body provides continuous compression throughout its length between the superior opening and the inferior opening when positioned over the segment of the limb;

the compression sleeve body comprised of a form fitting elastomeric fabric;

the compression sleeve having an inside surface for fitting to the segment of the limb and an opposite outside surface;

an elongated first pocket extending along a longitudinal axis extending between the superior opening and the opposite inferior opening and along the segment of the limb;

an elongated first weight positioned within the elongated first pocket, the elongated first weight configured to distribute weight along the segment of the limb;

a first hook and fastener area at a top portion of the compression sleeve body and a second hook and fastener area at a bottom portion of the compression sleeve;

wherein a top portion of the elongated first pocket is at the first hook and fastener area and a bottom portion of the elongated first pocket is at the second hook and fastener area;

a first strap configured to encircle the compression sleeve body at the top portion and secure the top portion of the elongated first pocket, the first strap secured by the first hook and fastener area; and a second strap configured to encircle the compression sleeve body at the bottom portion and secure the bottom portion of the elongated first pocket, the second strap secured by the second hook and fastener area;

wherein the first and second straps are configured to fix the elongated first weight within the elongated first pocket in position along the segment of the limb for distributing weight during physical activity.

2. The compression sleeve of claim 1 wherein the elongated first pocket has an opening to provide access to the elongated first pocket for inserting and removing the elongated first weight from the pocket.

3. The compression sleeve of claim 2 wherein the opening is positioned along a superior edge of the elongated first pocket.

4. The compression sleeve of claim 2 wherein the opening is disposed on the outside surface of the compression sleeve.

5. The compression sleeve of claim 4 further comprising a sheath encapsulating the elongated first weight.

6. The compression sleeve of claim 5 wherein the sheath comprises a plastic coating.

7. The compression sleeve of claim 6 wherein the elongated first weight comprises a metal alloy.

8. The compression sleeve of claim 7 wherein the metal alloy is steel.

9. The compression sleeve of claim 8 wherein the elongated first weight weighs less than one pound.

10. The compression sleeve of claim 1 wherein the elongated first weight comprises a plurality of weighted beads contained within a sheath.

11. The compression sleeve of claim 10 wherein the elongated first weight removably fits within the elongated first pocket.

12. The compression sleeve of claim 10 wherein the sheath comprises a plurality of separated compartments and wherein subsets of the plurality of weighted beads are placed within each of the plurality of separated compartments to distribute weight between the separated compartments.

13. The compression sleeve of claim 1 wherein the form fitting elastomeric fabric comprises elastane.

14. The compression sleeve of claim 1 wherein the compression sleeve is an arm compression sleeve, the limb is an arm, and wherein the elongated first weight within the elongated first pocket is positioned for fitting along a forearm of the arm.

15. The compression sleeve of claim 1 wherein the compression sleeve is a leg compression sleeve, the limb is a leg, and wherein the elongated first weight within the elongated first pocket is positioned for fitting along a shin of the leg.

16. The compression sleeve of claim 1 further comprising an elongated second pocket disposed at the inside surface and spaced apart from the elongated first pocket.

17. The compression sleeve of claim 16 further comprising an elongated second weight for fitting within the elongated second pocket.

18. The compression sleeve of claim 16 comprising the second pocket and a weight container for placement within the second pocket.

19. The compression sleeve of claim 18 wherein the weight container comprises a pouch with a plurality of weighted beads disposed therein.

20. The compression sleeve of claim 18 wherein the second pocket is an outer pocket.

21. The compression sleeve of claim 1 wherein the elongated first pocket is sewn-in.

22. The compression sleeve of claim 1 wherein the compression sleeve body is a compression sock body.

23. The compression sleeve of claim 1 wherein the elongated first pocket is sealed.

24. A compression sleeve, comprising:

a compression sleeve body having a superior opening and an opposite inferior opening for a pressure applying fit to a body part;

the compression sleeve body comprised of a form fitting elastomeric fabric extending continuously between the superior opening and the opposite inferior opening and providing compression throughout out its length;

the compression sleeve having an inside surface for pressure applying, form fitting to the body part and an opposite outside surface;

an open and elongated first pocket, the elongated first pocket extending along a longitudinal axis extending between the superior opening and the opposite inferior opening; and a removable heat pack for fitting within the elongated first pocket;

a first strap, the first strap for wrapping around the compression sleeve at a top portion, the first strap configured for encircling the body part which is fully within the compression sleeve with a first hook and fastener area at the top portion of the compression sleeve and a second strap, at a bottom portion, the second strap for wrapping around the compression sleeve at a bottom portion, the second strap configured for encircling the body part which is fully within the compression sleeve with a second hook and fastener area at the bottom portion of the compression sleeve; and wherein a top portion of the elongated first pocket is at the first hook and fastener area and a bottom portion of the elongated first pocket is at the second hook and fastener area, wherein the first and second hook and fastener areas secure the elongated first pocket against the body part to maintain precise positioning of the removable heat pack along the body part.

25. The compression sleeve of claim 24 wherein the heat pack is a chemical heat pack.

26. A compression garment, comprising:

a compression garment body for pressure applying fit to a body part;

the compression garment body having a first end and a second end;

the compression garment body having an opening at the first end;

the compression garment body comprised of a form fitting elastomeric fabric providing continuous compression between the first end and the second end when fit to the body part;

the compression garment body having an inside surface for fitting to the body part and an opposite outside surface;

an open and elongated first pocket disposed at the inside surface, the elongated first pocket configured to extend along a longitudinal axis of the body part; and a heat pack for removably fitting within the elongated first pocket;

an integral first strap, the first strap for wrapping around the compression garment at a top portion, the first strap configured for encircling the body part which is fully within the compression garment with a first hook and fastener area at the top portion of the compression garment body and an integral second strap, the second strap for wrapping around a bottom portion, the second strap encircling the body part which is fully within the compression garment with a second hook and fastener area at the bottom portion of the compression garment body; and wherein a top portion of the elongated first pocket is on the inside surface of the sleeve and the first hook and fastener area is on the outside surface above the top portion of the elongated first pocket on the inside surface of the sleeve and a bottom portion of the elongated first pocket is on the inside surface of the sleeve and the second hook and fastener area is on the outside surface above the bottom portion of the elongated first pocket on the inside surface of the sleeve, wherein the first and second hook and fastener areas secure the first and second straps, and the first strap on the outside surface secures the top portion of the elongated first pocket on the inside surface of the sleeve against the body, wherein the heat pack is configured to distribute therapeutic heat along the longitudinal axis of the body part.

27. The compression garment of claim 26 wherein the heat pack is a chemical heat pack.

28. A compression sleeve, comprising:

a compression sleeve body having a superior opening and an opposite inferior opening for fitting to a body part, wherein the compression sleeve body provides continuous compression throughout its length between the superior opening and the inferior opening when positioned over the body part;

the compression sleeve body comprised of a form fitting elastomeric fabric;

the compression sleeve having an inside surface for fitting to the body part and an opposite outside surface;

a plurality of pockets;

wherein a first subset of the pockets are accessible to a user for insertion of at least one of a weight and a heat pack;

wherein a second subset of the pockets are sealed and inaccessible to the user and wherein the second subset of the pockets contain weights;

a first strap, the first strap for wrapping around the compression sleeve at a top portion overlapping an elongated first pocket of the plurality of pockets, the first strap configured for encircling the body part within the compression sleeve; a first hook and fastener area at the top portion of the compression sleeve body and a second strap, the second strap for wrapping around the compression sleeve at a bottom portion the second strap configured for encircling the body part which is fully within the compression sleeve with a second hook and fastener area at a bottom portion of the compression sleeve, wherein the first and the second hook and fastener areas and the first and second straps secure the weighted compression sleeve to the body part; and wherein a top portion of the elongated first pocket is at the first hook and fastener area and a bottom portion of the elongated first pocket is at the second hook and fastener area.

* * * * *